US008707600B2

(12) United States Patent
Engelby

(10) Patent No.: US 8,707,600 B2
(45) Date of Patent: Apr. 29, 2014

(54) IN-STORE MARKETING SIGN

(75) Inventor: Daniel G. Engelby, Andover, MN (US)

(73) Assignee: Target Brands, Inc., Minneapolis, MN (US)

( * ) Notice: Subject to any disclaimer, the term of this patent is extended or adjusted under 35 U.S.C. 154(b) by 304 days.

(21) Appl. No.: 13/210,846

(22) Filed: Aug. 16, 2011

(65) Prior Publication Data

US 2012/0144706 A1 Jun. 14, 2012

Related U.S. Application Data

(60) Provisional application No. 61/421,768, filed on Dec. 10, 2010.

(51) Int. Cl.

| | |
|---|---|
| ***G09F 1/00*** | (2006.01) |
| ***G09F 11/00*** | (2006.01) |
| ***G09F 3/10*** | (2006.01) |
| ***G09F 3/18*** | (2006.01) |

(52) U.S. Cl.

USPC ..... 40/661.03; 40/124.05; 40/491; 40/638; 40/649; 40/642.02; 40/661; 40/657; 40/661.08; 40/672

(58) Field of Classification Search

USPC ..... 40/661.03, 124.05, 491, 638, 649, 40/642.02, 661, 642.07, 657, 661.08, 672

See application file for complete search history.

(56) References Cited

U.S. PATENT DOCUMENTS

| | | | |
|---|---|---|---|
| 362,758 | A | 5/1887 | Martin |
| 1,174,299 | A | 3/1916 | Taylor |
| 1,407,464 | A | 2/1922 | Garbe |
| 1,483,575 | A | 2/1924 | Fisher |
| 1,608,294 | A | 11/1926 | Beman |
| 2,108,343 | A | 2/1938 | McAllister |
| 2,288,728 | A | 7/1942 | Meredith |
| 2,297,888 | A | 10/1942 | Heileman |
| D134,298 | S | 11/1942 | Eppenstein |
| 2,720,044 | A | 10/1955 | Montalto |
| 2,833,074 | A | 5/1958 | Jannes |
| 2,941,664 | A | 6/1960 | Palmer |
| 2,984,031 | A | 5/1961 | Giesecke |

(Continued)

FOREIGN PATENT DOCUMENTS

FR 2870379 A1 11/2005

OTHER PUBLICATIONS

Communication dated Mar. 9, 2012 in corresponding Canadian application No. 2,759,938, 3 pages.

(Continued)

*Primary Examiner* — Syed A Islam

(74) *Attorney, Agent, or Firm* — Leanne Taveggia Farrell; Westman, Champlin & Koehler, P.A.

(57) ABSTRACT

A marketing sign is constructed of a sheet material and includes at least one break-away section coupled to a main section by at least one score. The main section includes a free portion, a base portion and connecting portion. The free portion includes a price piece and a balloon piece coupled to the price piece at a fold. The base portion is configured to couple with a product display structure after the main section is detached from the break-away section at the at least one score. The connecting bend line couples the free portion to the base portion and has a first end located a space distance from a right side edge of the sheet material.

21 Claims, 17 Drawing Sheets

(56) References Cited

U.S. PATENT DOCUMENTS

| | | | | |
|---|---|---|---|---|
| 3,077,686 | A | 2/1963 | Montalto | |
| 3,251,152 | A | 5/1966 | Takefman | |
| 3,423,860 | A | 1/1969 | Berry, Jr. et al. | |
| 3,706,150 | A | 12/1972 | Greenberger | |
| 3,709,150 | A | 1/1973 | Colombot | |
| 3,711,977 | A | 1/1973 | Blankenhorn | |
| 3,774,328 | A | 11/1973 | Tanney | |
| 3,824,720 | A | 7/1974 | Langwell | |
| D233,083 | S | 10/1974 | Ross | |
| 3,977,109 | A | 8/1976 | Berry, Jr. et al. | |
| D241,718 | S | 10/1976 | Hourahine | |
| 4,141,529 | A | 2/1979 | Casutt | |
| 4,161,074 | A | 7/1979 | DePinna | |
| 4,167,073 | A | 9/1979 | Tang | |
| 4,179,138 | A | 12/1979 | Bogdanovic | |
| 4,306,366 | A | 12/1981 | Taub | |
| 4,338,739 | A | 7/1982 | Greenberger | |
| 4,471,544 | A | 9/1984 | Nelles et al. | |
| 4,572,380 | A | 2/1986 | Langwell | |
| 4,693,441 | A | 9/1987 | Conway | |
| 4,713,899 | A | 12/1987 | Fast | |
| 4,716,669 | A | 1/1988 | Fast | |
| 4,718,627 | A | 1/1988 | Fast et al. | |
| 4,798,014 | A | 1/1989 | Stoerzinger et al. | |
| 4,919,377 | A | 4/1990 | Alexander et al. | |
| 4,930,234 | A | 6/1990 | Schmidt | |
| D338,241 | S | 8/1993 | Landa | |
| 5,682,698 | A | 11/1997 | Bevins | |
| 5,709,297 | A | 1/1998 | Brandriff et al. | |
| 5,848,698 | A | 12/1998 | Stompe | |
| D415,206 | S | 10/1999 | Gaines | |
| 5,967,343 | A | 10/1999 | Dufresne | |
| D427,526 | S | 7/2000 | Correll | |
| 6,145,232 | A | 11/2000 | Bevins | |
| 6,163,996 | A | 12/2000 | Gebka | |
| 6,193,457 | B1 | 2/2001 | Pacione | |
| 6,283,278 | B1 | 9/2001 | Holztrager | |
| 6,360,465 | B1 | 3/2002 | Simpson | |
| 6,516,546 | B1 | 2/2003 | Bremick | |
| D480,754 | S | 10/2003 | Berger | |
| 6,701,653 | B2 * | 3/2004 | Chess et al. | 40/638 |
| D498,843 | S | 11/2004 | Kielb et al. | |
| 6,817,127 | B2 | 11/2004 | Gottlieb et al. | |
| D502,031 | S | 2/2005 | Cassidy et al. | |
| D504,159 | S | 4/2005 | Best et al. | |
| 6,981,343 | B2 | 1/2006 | Rawlings et al. | |
| 7,055,274 | B2 | 6/2006 | Fast et al. | |
| 7,219,459 | B2 | 5/2007 | Valiulis et al. | |
| D554,921 | S | 11/2007 | Gordon et al. | |
| D556,265 | S | 11/2007 | Cuzzocrea | |
| 7,340,855 | B2 | 3/2008 | Wiltfang et al. | |
| D575,332 | S | 8/2008 | Parker et al. | |
| 7,578,088 | B2 | 8/2009 | Alves | |
| 7,587,849 | B2 | 9/2009 | Robbins et al. | |
| D608,395 | S | 1/2010 | Engelby et al. | |
| D623,235 | S | 9/2010 | Engelby et al. | |
| D623,236 | S | 9/2010 | Engelby et al. | |
| D630,126 | S | 1/2011 | Kim | |
| D630,257 | S | 1/2011 | Engelby et al. | |
| D633,570 | S | 3/2011 | Hilyard et al. | |
| 7,975,416 | B2 | 7/2011 | Engelby et al. | |
| 7,992,334 | B1 | 8/2011 | Engelby et al. | |
| 2002/0070266 | A1 | 6/2002 | Glenn et al. | |
| 2003/0020274 | A1 | 1/2003 | Milliorn | |
| 2004/0124629 | A1 | 7/2004 | Davis et al. | |
| 2004/0211820 | A1 | 10/2004 | Berger | |
| 2005/0155259 | A1 | 7/2005 | Virvo | |
| 2006/0010742 | A1 | 1/2006 | Steininger | |
| 2007/0241004 | A1 | 10/2007 | Squarzoni et al. | |
| 2011/0283578 | A1 | 11/2011 | Engelby et al. | |

OTHER PUBLICATIONS

Application and prosecution documents associated with U.S. Appl. No. 29/380,755 including: The application entitled In-Store Marketing Sign, filed Dec. 10, 2010, pp. 1-3; Office Action dated Jun. 9, 2011, pp. 4-7.

Application and prosecution documents associated with U.S. Appl. No. 29/380,758 including: The application entitled In-Store Marketing Sign, filed Dec. 10, 2010, pp. 1-10; Office Action dated Jun. 10, 2011, pp. 11-14; Office Action dated Aug. 8, 2011, pp. 15-20.

Application and prosecution documents associated with U.S. Appl. No. 29/380,762 including: The application entitled In-Store Marketing Sign, filed Dec. 10, 2010, pp. 1-10; Office Action dated Jun. 10, 2011, pp. 11-14; Notice of Allowance dated Aug. 10, 2011, pp. 15-20.

Application and prosecution documents associated with U.S. Appl. No. 13/154,830 including: The application entitled In-Store Marketing Sign, filed Jun. 7, 2011, pp. 1-27; Office Action dated Aug. 8, 2011, pp. 28-38.

Pending U.S. Appl. No. 13/155,149, filed Jun. 7, 2011, entitled In-Store Marketing Sign, pp. 1-29.

Pending U.S. Appl. No. 29/399,587, filed Aug. 16, 2011, entitled In-Store Marketing Sign, pp. 1-10.

* cited by examiner

IN-STORE MARKETING SIGN

BACKGROUND

Retail establishments commonly use various types of display structures to present products to customers for purchase. These display structures both support the product for display and indicate the product price. Example display structures include shelf-type structures and peg-type structures.

In general, shelf-type display structures display the product by resting it on shelves. Each shelf has a channel that holds a shelf-type price label support that supports a price label along the front of the shelf. The price label provides pricing and product information for the products stacked on the shelves.

Peg-type display structures generally display products by hanging the products from a peg. Typically, each peg-type display structure includes a top peg fixture for supporting a price label support that supports a price label and a bottom peg fixture for supporting products.

Often, retailers desire to highlight certain products that are being displayed for sale. For example, a retailer may want to bring certain products to the attention of the customer because they were advertised in a certain media format, such as a catalog, a mailer or a commercial. In another example, a retailer may want to highlight certain products that have certain characteristics not possessed by similarly displayed products, such as products that are on sale or products that offer promotional incentives with its purchase. In yet another example, a retailer may want to temporarily change the prices of certain products to reflect a sale price.

Often, retailers highlight these select products by enhancing the visual appearance of the price labels by adding additional visual elements that extend beyond the normal price label or cover the regular price label so as to draw attention to the product.

The discussion above is merely provided for general background information and is not intended to be used as an aid in determining the scope of the claimed subject matter.

SUMMARY

A marketing sign is constructed of a sheet material and has a bottom edge, at least one break-away section and a main section coupled to the at least one break-away section by at least one score. According to one embodiment, a top of the main section can be defined by the at least one score and a bottom of the main section is defined at least by the bottom edge of the sheet material. According to another embodiment, a left side edge of the main section can be defined by the at least one score and a bottom of the main section is defined at least by the bottom edge of the sheet material The main section includes a free portion including a price piece having indicia indicative of a price of a product that the sign is marketing and a balloon piece including indicia indicative of information about the product. The balloon piece is coupled to the price piece at a fold. The main section includes a base portion configured to couple with a production display structure after the main section is detached from the break-away section. The main section also includes a connecting bend line that couples the free portion to the base portion. The connecting bend line has a first end located a spaced distance from a right side edge of the sheet material.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein utilize an in-store marketing sign made from sheet material to enhance or highlight various products being supported on a display structure. Each marketing sign embodiment is made from the same general sheet material size and includes at least one break-away section or break-off portion for forming the marketing sign into the desired size and shape depending on whether the sign is for a shelf-type display structure or a peg-type display structure. For example, the marketing sign can be broken down into various sizes and utilized with a shelf-type display structure, which includes a price holder for supporting at least one price label. The marketing sign can also be broken down to be utilized with a peg-type display structure, which includes a price holder coupled to a peg fixture.

Figure 1A:
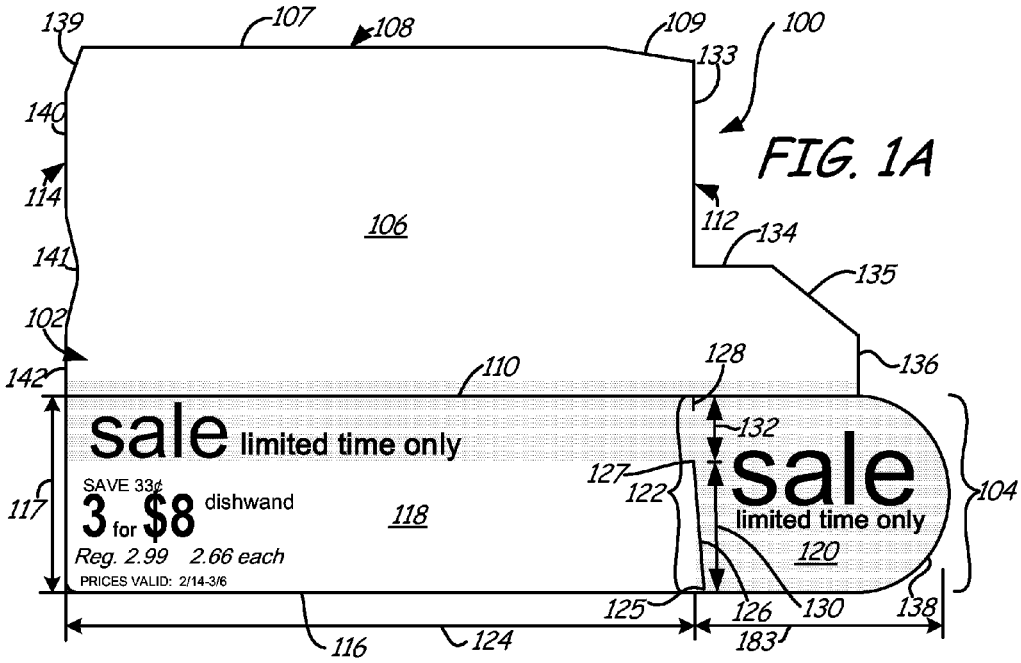
FIG. 1A is a front view of an in-store marketing sign for a shelf-type display structure according to one embodiment.

FIG. 1A is a front view of an in-store marketing sign 100 illustrating a front surface 102 according to one embodiment. Marketing sign 100 is for use with a shelf-type product display structure and is made with a pliable yet resilient sheet material. One exemplary sheet material includes polystyrene; however, other resilient sheet materials may be used. The marketing sign 100 can be manufactured with a variety of different types of punch and die machines and/or laser machines.

Marketing sign 100 includes a main section or portion 104 and a break-away section or break-off portion 106 coupled to the main section 104 by a score 110. As illustrated in FIG. 1A, score 110 is a continuous groove formed in the sheet material. However, it should be realized, other types of markings are possible. For example, score 110 can be perforations. Break-away section 106 is defined at least between a break-away top edge 108, the score 110, a break-away right side edge 112 and a break-away left side edge 114. At least a portion of break-away top edge 108 and score 110 are oriented substantially parallel with each other and at least portions of break-away right and left side edges 112 and 114 are in parallel with each other, while at least a portion of break-away top edge 108 and score 110 are oriented substantially perpendicular to at least portions of break-away right side edge 112 and break-away left side edge 114.

Main section 104 is defined at least between score 110 and a bottom edge 116 of marketing sign 100, where score 110 is substantially parallel with bottom edge 116. Main section 104 is sized such that its height 117 is about 38.1 mm or 1.5 inches. Main section 104 includes a price piece or price portion 118 coupled to a balloon piece or balloon portion 120 at a fold or bend 122. Price piece 118 of marketing sign 100 is sized such that its width 124 is about 127 mm or 5 inches. As illustrated, price piece 118 includes (along with other information) a printed price and printed indicia.

Break-away right side edge 112 includes four different edge sections. The first edge section 133 intersects a second edge section 109 of break-away top edge 108 and is substantially perpendicular to score 110. The second edge section 134 intersects with and is substantially perpendicular to first edge section 133. The third edge section 135 intersects with and is oriented about 40 degrees from second edge section 134. The fourth edge section 136 intersects with third edge section 135 at one end and with score 110 at the other end. Fourth edge section 136 is substantially perpendicular to score 110 and second edge section 134, but substantially in parallel with first edge section 133. Second edge section 134, third edge section 135 and fourth edge section 136 provide a set of angled edges for which a vacuum on a feeding machine can pick up the marketing sign 100 after it is formed.

Break-away top edge 108 includes two different edge sections. The first edge section 107 intersects with a first edge section 139 of break-away left side edge 114 and is substantially in parallel with score 110 and substantially perpendicular to first edge section 133 of break-away right side edge 112. Second edge section 109 intersects with first edge section 107 at one end and with the first edge section 133 of break-away right side edge 112 at the other end. Second edge section 109 is oriented about 10 degrees from first edge section 107. The taper of second edge section 109 provides marketing sign 100 with a "bumper." The "bumper" ensures marketing sign 100 is not impeded during travel while the sign is being formed.

Break-away left side edge 114 includes at least three different edge sections. More particularly and in the embodiment illustrated in FIG. 1A, break-away left side edge includes four different edge sections. The first edge section 139 intersects with first edge section 107 of break-away top edge 108. First edge section 139 is oriented about 110 degrees from first edge section 107 of break-away top edge 108. This taper, like second edge section 109 of break-away top edge 108, provides marketing sign 100 with a "bumper" that ensures the marketing sign is not impeded during travel while the sign is being formed. The second edge section 140 of break-away left side edge 114 intersects first edge section 139 and is substantially perpendicular to first edge section 107 of break-away top edge 108. The third edge section 141 is a curved thumb indent. Third edge section 141 or thumb indent is placed along break-away side edge to help identify the sign from other sign types that are stacked together in a single stack. The fourth edge section 142 intersects with third edge section 141 at one end and is substantially perpendicular to break-away top edge 108 and bottom edge 116 and thereby in alignment with second edge section 140. Fourth edge section 142 intersects with bottom edge 116 at the other end. Fourth edge section 142 and bottom edge 116 intersect at a rounded corner.

Fold 122 includes a slit or through cut portion 126 and a scored fold portion 128. Slit portion 126 includes a continuous through cut in the sheet material and includes a first end 125 and a second end 127. The first end 125 of slit portion 126 is spaced apart from bottom edge 116 by a spaced distance. This spaced distance is a balloon tie. The balloon tie connects balloon piece 120 to price piece 118 until the balloon tie is broken. The through cut and the balloon tie extend for a distance or height 130 of about 25.4 mm or 1 inch from bottom edge 116. Slit portion 126 is oriented about 85 degrees from bottom edge 116. In other words, slit portion 126 is oriented about five degrees from a line that is perpendicular with bottom edge 116. As illustrated in FIG. 1A, scored fold portion 128 is a continuous groove in the sheet material and intersects substantially perpendicularly with score 110. Scored fold portion 128 is in alignment with first edge section 133 of break-away right side edge 112. Scored fold portion 128 extends for a distance of about 3.175 mm or ⅛ of an inch from a point where scored fold portion 128 intersects with score 110. After break-away section 106 is detached, a distance 132 along fold 122 and scored fold portion 128 is bent. The bent distance 132 intersects with and is substantially perpendicular to score 110 and intersects with second end 127 of slit portion 126. Because scored fold portion 128 does not span the entire distance 132, score fold portion 128 provides a resilient connection between price piece 118 and balloon piece 120 while still allowing scored fold portion 128 of fold 122 to orient balloon piece 120 out-of-plane from price piece 118 along bend distance 132. It should be realized, however, scored fold portion 128 can be located along fold 122 in other places or can include more than one score. In addition, scored fold portion 128 can have other types of suitable markings, such as perforations that would aid in a resilient connection yet bend the sheet material along the marking.

Balloon piece 120 is defined at least by score 110. Balloon piece 120 is also defined at least by bottom edge 116. A curved balloon edge 138 connects score 110 to bottom edge 116. Balloon piece 120 of marketing sign 100 is sized such that its width 183 is greater than about 50.8 mm or 2 inches. As illustrated, balloon piece 120 includes printed indicia.

Figure 1B:
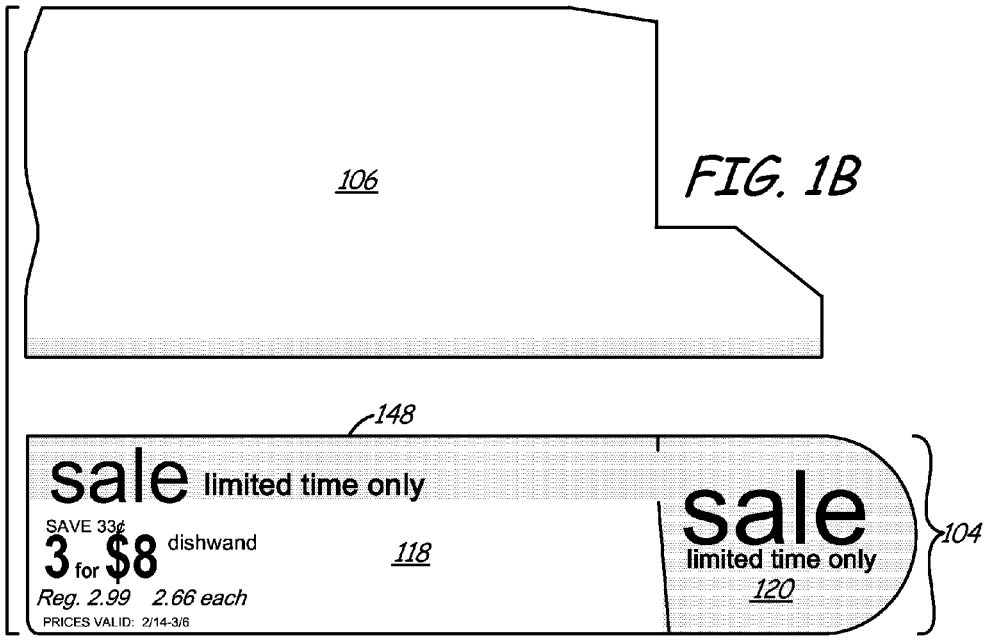
FIG. 1B is a front view of the in-store marketing sign of FIG. 1A with a detached break-away section.

FIG. 1B is a front view of in-store marketing sign 100 of FIG. 1A with the break-away section 106 separated from main section 104. In the store, a user detaches break-away section 106 from main section 104 at score 110 and discards break-away section 106. By detaching break-away section 106, score 110 becomes the top edge 148 of price piece 118. Top edge 148 of price piece 118 also defines the top edge of balloon piece 120.

Figure 2A:
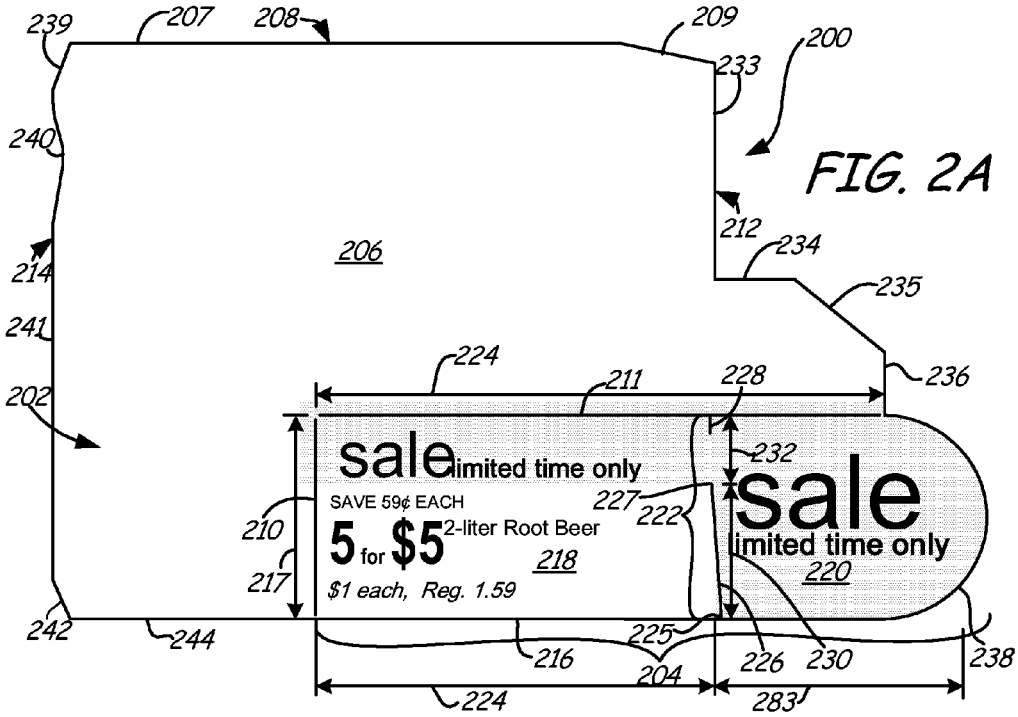
FIG. 2A is a front view of an in-store marketing sign for a shelf-type display structure according to another embodiment.

FIG. 2A is a front view of an in-store marketing sign 200 illustrating a front surface 202 according to one embodiment. Marketing sign 200 is also for use with a shelf-type product display structure and is made, like marketing sign 100, with a pliable yet resilient sheet material.

Marketing sign 200 includes a main section or portion 204 and a break-away section or break-off portion 206. Break-away section 206 is coupled to main section 204 by a first score 210 and a second score 211. First score is substantially perpendicular to second score 211.

Break-away section 206 is defined at least by a break-away top edge 208, a break-away bottom edge 244, the first score 210, the second score 211, a break-way right side edge 212 and a break-away left side edge 214. At least a portion of break-away top edge 208 and second score 211 are oriented substantially in parallel with each other and at least portions of break-away right side edge 212 and left side edge 214 are in parallel with each other, while at least a portion of break-away top edge 208 and second score 211 are oriented substantially perpendicular to at least portions of break-away right side edge 212 and break-away left side edge 114.

Main section 204 is defined at least by first score 210, second score 211, a bottom edge 216 and a curved balloon edge 238. Bottom edge 216 is substantially parallel to second score 211 and intersects with and is in alignment with break-away bottom edge 244. Main section 204 is sized such that its height 217 is about 38.1 mm or 1.5 inches. Main section 204 includes a price piece or price portion 218 coupled to a balloon piece or balloon portion 220 at a fold or bend 222. Price piece 218 of marketing sign 200 is sized such that its width 224 is about 76.2 mm or 3 inches. As illustrated, price piece 218 includes (along with other information) a printed price and printed indicia.

Break-away right side edge 212 includes four different edge sections. The first edge section 233 intersects a first edge section 239 of break-away top edge 208 and is substantially perpendicular to second score 211. Second edge section 234 intersects with and is substantially perpendicular to first edge section 233. Third edge section 235 intersects with and is oriented about 40 degrees from second edge section 234. Fourth edge section 236 intersects with third edge section 235 at one end and with balloon edge 238 at the other end. Fourth edge section 236 is substantially perpendicular to second score 211 and second edge section 234, but substantially in parallel with first edge section 233. Second edge section 234, third edge section 235 and fourth edge section 236 provide a set of angled edges by which a vacuum on a machine can pick up the marketing sign 200 after it is formed.

Break-away top edge 208 includes two different edge sections. The first edge section 207 intersects with first edge section 239 of break-away left side edge 214 and is substantially in parallel with second score 211 and substantially perpendicular to first edge section 233 of break-away right side edge 212. The second edge section 209 intersects with first edge section 207 at one end and with the first edge section 233 of break-away right side edge 212 at the other end. Second edge section 209 is oriented about 10 degrees from first edge section 207. The taper of second edge section 209 provides marketing sign 200 with a "bumper." The "bumper" ensures marketing sign 200 is not impeded during travel while the sign is being formed.

Break-away left side edge 214 includes at least three different edge sections. More particularly and in the embodiment illustrated in FIG. 2A, break-away left side edge 214 includes four different edge sections. The first edge section 239 intersects with first edge section 207 of break-away top edge 208. First edge section 239 is oriented about 110 degrees from first edge section 207 of break-away top edge 208. This taper, like second edge section 209 of break-away top edge 208, provides marketing sign 200 with a "bumper" that ensures the marketing sign is not impeded during travel while the sign is being formed. Second edge section 240 is a curved thumb indent. Second edge section 240 or thumb indent intersects first edge section 239 and is placed along break-away left side edge 214 to help identify the sign from other sign types that are stacked together in a single stack. The third edge section 241 intersects with second edge section 240 and is substantially perpendicular to break-away top edge 208 and break-away bottom edge 244. Fourth edge section 242 intersects with third edge section 241 at one end and intersects with break-away bottom edge 244 at the other end. Fourth edge section 242 is oriented about 115 degrees from break-away bottom edge 244.

With reference back to main section 204 and the embodiment illustrated in FIG. 2A, first score 210 and second score 211 are slits or through cuts in the sheet material. First score 210 is substantially perpendicular to bottom edge 216 and second score 211, but does not intersect with bottom edge 216 or second score 211. As illustrated, one end of first score 210 is spaced apart a spaced distance from bottom edge 216 by a bottom edge tie and the other end of first score 210 is spaced apart a spaced distance from second score 211 by a score tie. Second score is substantially perpendicular to fourth edge section 236 of break-away right side edge 212 and to first score 210, but does not intersect with fourth edge section 236 or first score 210. As illustrated, the one end of second score 211 is spaced apart a spaced distance from fourth edge section 236 by a right side edge tie and the other end of second score 211 is spaced apart a spaced distance from first score 210 by the score tie. The bottom edge tie, the right side edge tie and the score tie connect main section 204 to break-away section 206 until the ties are broken when detaching main section 204 from break-away section 206. It should be realized that first score 210 and second score 211 can include other types of markings than through cuts. For example, first score 210 and second score 211 can be continuous grooves that intersect with each other and with bottom edge 216 and fourth edge section 236. In another example, first score 210 and second score 211 can be perforated lines that intersect with each other and with bottom edge 216 and fourth edge section 236.

Fold 222 includes a slit or through cut portion 226 and a scored fold portion 228. Slit portion 226 is a continuous through cut in the sheet material and includes a first end 225 and a second end 227. The first end 225 of slit portion 226 is spaced apart from bottom edge 216 by a spaced distance. This spaced distance is a balloon tie. The balloon tie connects balloon piece 220 to price piece 218 until the balloon tie is broken. The through cut and the balloon tie extend for a distance or height 230 of about 25.4 mm or 1 inch from bottom edge 216. Slit portion 226 is oriented about 85 degrees from bottom edge 216. In other words, slit portion 226 is oriented about five degrees from a line that is perpendicular with bottom edge 216. As illustrated in FIG. 2A, scored fold portion 228 is a continuous groove in the sheet material and intersects substantially perpendicularly with second score 211. Scored fold portion 228 is in alignment with first edge section 233 of break-away right side edge 212. Scored fold portion 228 extends for a distance of about 3.175 mm or ⅛ of an inch from a point where scored fold portion 228 intersects with second score 210. After break-away section 206 is detached, the distance 232 along fold 222 and scored fold portion 228 is bent. The bent distance 232 is substantially perpendicular to second score 211 and intersects with second end 227 of slit portion 226. Because scored fold portion 228 does not span the entire distance 232, scored fold portion 228 provides a resilient connection between price piece 218 and balloon piece 220 while still allowing scored fold portion 228 of fold 222 to orient balloon piece 220 out-of-plane from price piece 218 along bend distance 232. It should be realized, however, scored fold portion 228 can be located along fold 222 in other places or can include more than one score. In addition, scored fold portion 228 can have other types of suitable markings, such as through cuts or perforations that would aid in a resilient connection yet bend the sheet material along the marking.

Balloon piece 220 is defined at least by second score 211 and bottom edge 216. Curved balloon edge 238 connects second score 211 to bottom edge 216. Balloon piece 220 of marketing sign 200 is sized such that its width 283 is greater than about 50.8 mm or 2 inches. As illustrated, balloon piece 220 includes printed indicia.

Figure 2B:
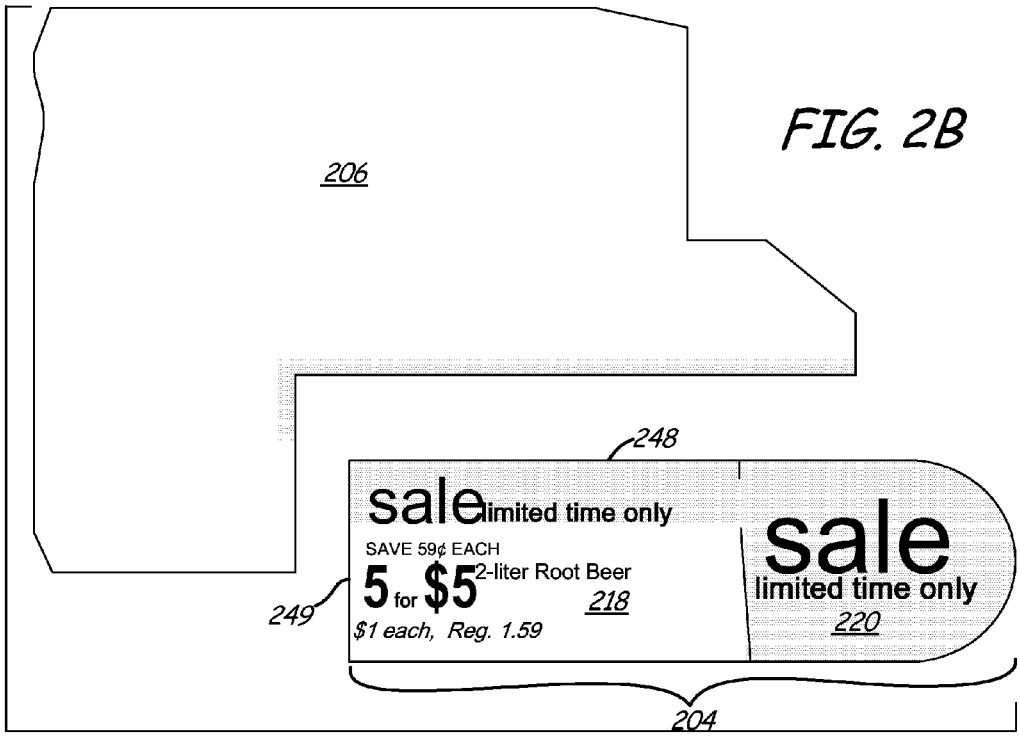
FIG. 2B is a front view of the in-store marketing sign of FIG. 2A with a detached break-away section.

FIG. 2B is a front view of in-store marketing sign 200 illustrated in FIG. 2A with break-away section 206 separated from main section 204. In the store, a user detaches and discards break-away section 206 from main section 204 by punching out the bottom edge, score and right side edge ties. By detaching break-away section 206, first score 210 becomes the left side edge 249 of main section 204 and second score 211 becomes a top edge 248 of main section 204.

Figure 3:
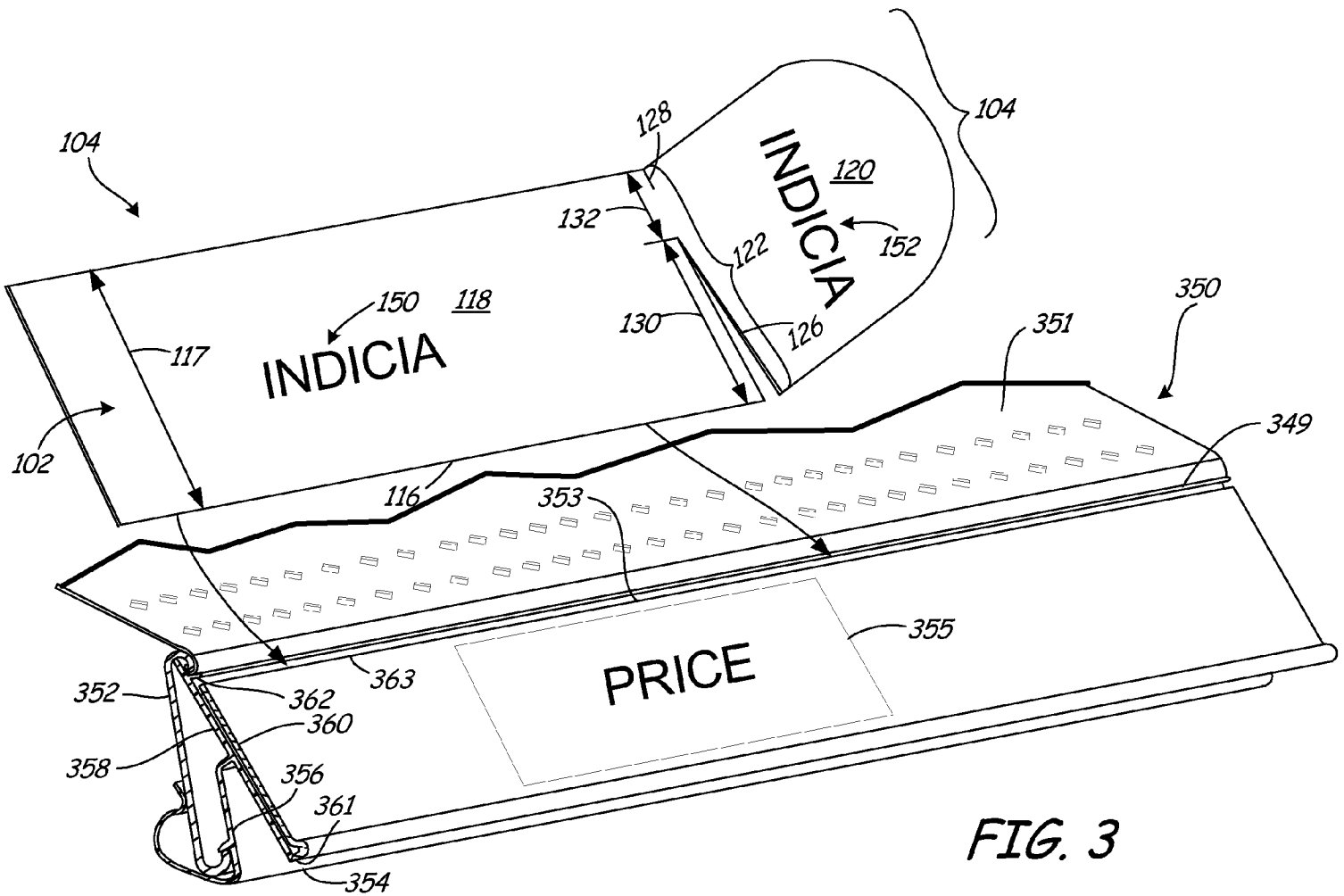
FIG. 3 is a perspective view of the remaining portion of the in-store marketing sign illustrated in FIG. 1B exploded from a perspective sectional view of a shelf-type display structure according to one embodiment.

FIG. 3 is a perspective view of main section 104 of marketing sign 100 illustrated in FIG. 1B exploded from a perspective sectional view of a shelf-type display structure 350 according to one embodiment. It should be noted that while FIG. 3 illustrates marketing sign 100, it should be realized that shelf-type-display structure 350 can also accommodate main section 204 of marketing sign 200 in its break-away configuration illustrated in FIG. 2B. In FIG. 3, after break-away section 106 is removed from main section 104, the balloon tie holding price piece 118 and balloon piece 120 together along bottom edge 116 is broken such that marketing sign 100 is bent at fold 122 and balloon piece 120 is oriented out-of-plane from front surface 102 of price piece 118. By breaking the balloon tie, slit portion 126 now intersects with bottom edge 116.

Shelf-type display structure 350 includes a shelf 351 coupled to a price holder support structure or channel 352 at a bull nose 349. Channel 352 is oriented at an angle from shelf 351. Channel 352 is configured to retain a price holder 354. As more easily illustrated in the perspective section in FIG. 3 of price holder 354, the price holder is an integrally formed component configured to retain a price label strip 353 having a plurality of price labels 355 (of which one price label is shown in FIG. 3). Price holder 354 is typically formed of a polymer such as plastic. Price holder 354 includes a support 356 configured to engage with channel 352. Price holder 354 also includes a back side 358 coupled to a front side 360 at a joined bottom end portion 361. At least front side 360 is formed of a transparent polymer such that a price label 355 can be clearly viewed. Front side 360 includes a top edge 363. Back side 358 includes an extension 362 located in proximity to the top of the back side. Extension 362 protrudes from the back side 358 towards top edge 363 of front side 360 and is located just below or in contact with bull nose 349 of display structure 350. It should be realized, back side 358 and front side 360 are coupled together at jointed bottom end portion 361 only and not at top ends. Price label strip 353 can be inserted between the back side 358 and the front side 360 of price holder 354 from the side or top down. Extension 362 or bull nose 349 secures price label strip 353 into place.

To physically alter the price holder, price piece 118 of marketing sign 100 is configured to be inserted between back side 358 and front side 360 of price holder 354 so as to cover the regular price label 355 of price label strip 353, while balloon piece 120 is left outside of price holder 354. In other words, only price piece 118 is configured to engage with or couple to a price holder 354, not balloon piece 120. The height 117 of main section 104 is dimensioned such that it is larger than the distance between bottom end portion 361 and top edge 363 of price holder 354. More particularly, the distance between bottom end portion 361 and top edge 363 of price holder 354 is substantially equivalent to the distance or height 130 of slit portion 126. Therefore, the distance of main section 104 that protrudes from price holder 354 is substantially equivalent to the distance or height 132 of scored fold portion 128 of fold 122.

Figure 4:
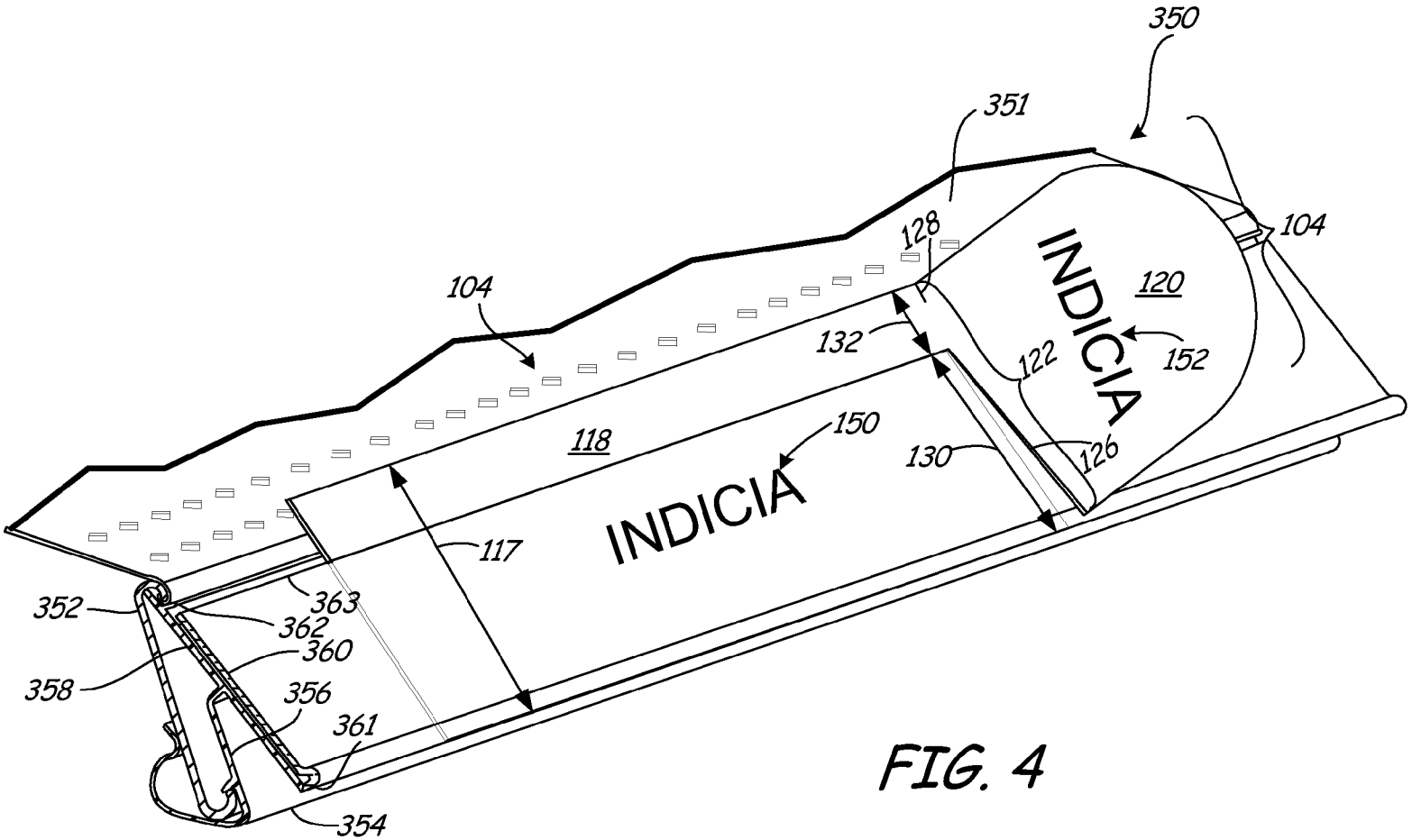
FIG. 4 is a perspective view of the remaining portion of the in-store marketing sign illustrated in FIG. 1B mounted to the perspective sectional view of the shelf-type display structure illustrated in FIG. 3.
Figure 5:
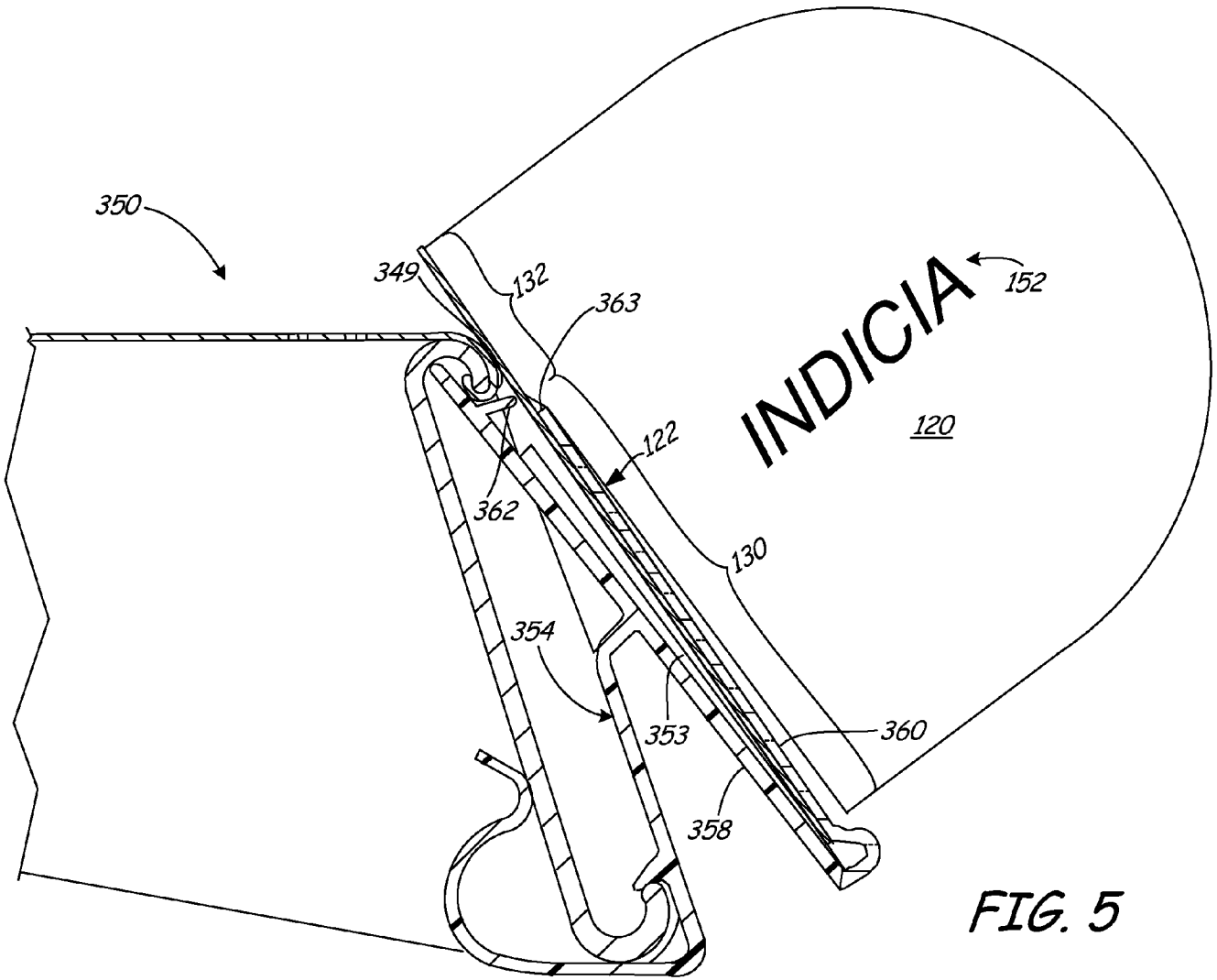
FIG. 5 is a side view of the remaining portion of the in-store marketing sign of FIG. 1B mounted to the side sectional view of the shelf-type display structure illustrated in FIG. 4

The protruding section of main section 104 allows balloon piece 120 to be coupled to price piece 118 at scored fold portion 128, while still being bent out-of-plane from price piece 128 and located outside of price holder 354. For example, as illustrated in the perspective view of marketing sign 100 as mounted to a perspective sectional view of shelf-type display structure 350 in FIG. 4 and the side view of marketing sign 100 and shelf-type display structure 350 in FIG. 5, price piece 118 is located between back side 358 and front side 360 of price holder 354 and balloon piece 120 or the slit portion 126 of fold 122 rests on the front surface of front side 360.

In one embodiment, price piece 118 includes indicia 150 indicative of a price of a product and product information for the product that sign 100 is marketing and balloon piece 120 includes indicia 152 indicative of promotional information about the product the sign 100 is marketing. Upon marketing sign 100 covering the regular price label 355, marketing sign indicates a new price with indicia 150 located on price piece 118 and further highlights promotional features of the product with indicia 152 located on balloon piece 120. As illustrated, indicia 152 are located on a front side 102 of balloon piece 120. Indicia are also located on a back side of balloon piece 120 (not specifically illustrated) such that indicia on balloon piece 120 are double sided.

Figure 6A:
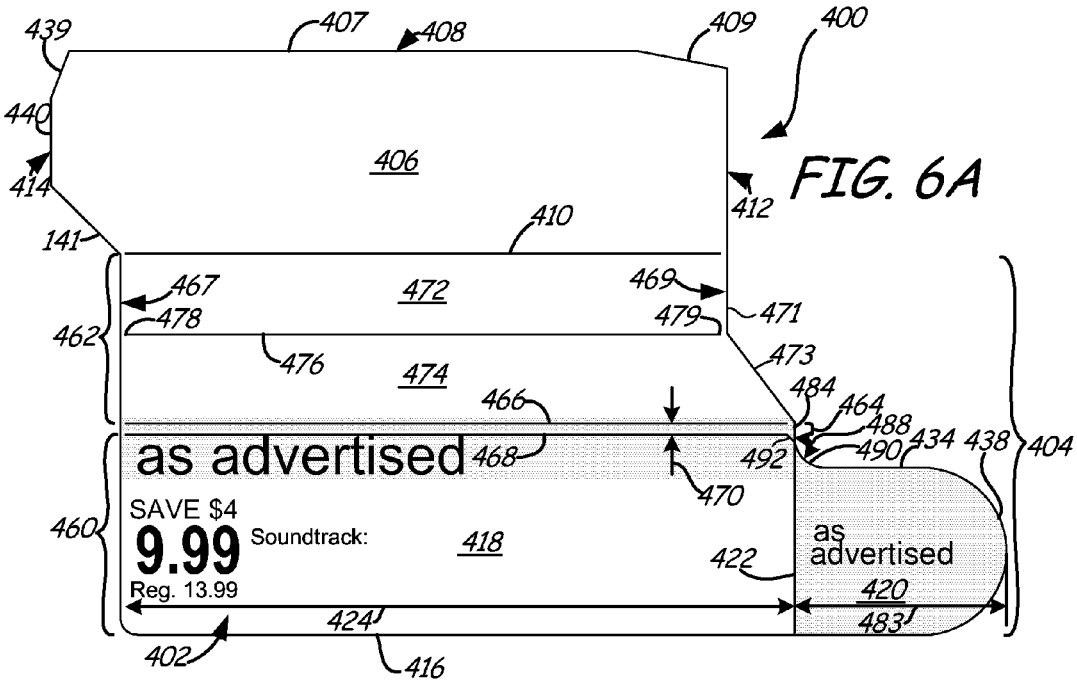
FIG. 6A is a front view of an in-store marketing sign for a shelf-type display structure according to yet another embodiment.

FIG. 6A is a front view of an in-store marketing sign 400 illustrating a front surface 402 according to one embodiment. Marketing sign 400 is also for use with a shelf-type product display structure, such as shelf-type display structure 350, and is made, like marketing signs 100 and 200, with a pliable yet resilient sheet material.

Marketing sign 400 includes a main section or portion 404 and a break-away section or break-off portion 406 coupled to the main section 404 by a score 410. As illustrated in FIG. 6A, score 410 is a continuous groove formed in the sheet material. However, it should be realized, other types of markings are possible. For example, score 410 can be a perforated line or through cuts. Break-away section 406 is defined at least between a break-away top edge 408, the score 410, a break-away right side edge 412 and a break-away left side edge 414. At least a portion of break-away top edge 408 and score 410 are oriented substantially parallel with each other and at least portions of break-away right and left side edges 412 and 414 are in parallel with each other, while at least a portion of break-away top edge 408 and score 410 are oriented substantially perpendicular to at least portions of break-away right side edge 412 and break-away left side edge 414.

Break-away top edge 408 includes two different edge sections. The first edge section 407 intersects with a first edge section 439 of break-away left side edge 414 and is substantially in parallel with score 410 and substantially perpendicular to break-away right side edge 412. Second edge section 409 intersects with first edge section 407 at one end and with the break-away right side edge 412 at the other end. Second edge section 409 is oriented about 10 degrees from first edge section 407. The taper of second edge section 409 provides marketing sign 400 with a "bumper." The "bumper" ensures marketing sign 400 is not impeded during travel while the sign is being formed.

Break-away left side edge 414 includes at least three different edge sections. The first edge section 439 intersects with first edge section 407 of break-away top edge 408. First edge section 439 is oriented about 110 degrees from first edge section 407 of break-away top edge 408. This taper, like second edge section 409 of break-away top edge 408, provides marketing sign 400 with a "bumper" that ensures the marketing sign is not impeded during travel while the sign is being formed. The second edge section 440 of break-away left side edge 414 intersects first edge section 439 and is substantially perpendicular to first edge section 407 of break-away top edge 408. The third edge section 441 intersects with second edge section 440 and terminates at or near score 410. Third edge section 441 is oriented about 45 degrees from second edge section 440.

Main section 404 is defined at least between score 410 and a bottom edge 416 of marketing sign 400, where score 410 is substantially parallel with bottom edge 416. Main section 404 includes a free portion 460, a base portion 462 and a connecting portion 464, which couples the free portion 460 to the base portion 462. Connecting portion 464 is defined at least between a first connecting bend line 466 spaced apart from a second connecting bend line 468 by a distance 470. For example, distance 470 can be about 2 cm. Base portion 462 is defined by score 410, first connecting bend line 466, a base left side edge 467 and a base right side edge 469. Base left side edge 467 is substantially parallel with second edge section of break-away left side edge 414. Base right side edge 469 includes a first edge section 471 in alignment with break-away right side edge 412 when main section 404 is coupled to break-away section 406 and a second edge section 473. Base portion 462 includes an engaging piece 472 coupled to a support piece 474 at a base bend line 476. As illustrated in FIG. 6A, base bend line 476 is oriented substantially parallel with the first and second connecting bend lines 466 and 468. In one embodiment, base bend line 476 includes a continuous groove extending from a first end 478 to a second end 479. However, it should be realized, as discussed in regards to other bend lines, base bend line 476 can be other types of suitable markings, such as spaced apart slits or perforations that would aid in bending the sheet material along the marking.

Engaging piece 472 is defined at least between score 410, base bend line 476, base left side edge 467 and first edge section 471 of base right side edge 469. Support piece 474 is defined at least between first connecting bend line 466, base bend line 476, base left side edge 467 and second edge section 473 of base right side edge 469. Connecting portion 464 couples support piece 474 of base portion 462 to free portion 460 such that first connecting bend line 466 is adjacent support piece 474 and second connecting bend line 468 is adjacent free portion 460.

Free portion 460 of main section 404 includes a price piece 418 coupled to a balloon piece 420 at a fold or bend 422. Fold 422 includes a continuous groove in the sheet material and intersects substantially perpendicularly with bottom edge 416. However, it should be realized, fold 422 can be other types of markings, such as spaced apart markings, through cuts or a perforated line that would aid in bending the sheet material along the marking.

Price piece 418 is sized such that its width 424 is about 127 mm or 5 inches according to one embodiment. As illustrated, price piece 418 includes (along with other information) a printed price and printed indicia. Balloon piece 420 is defined by at least a top edge 434 spaced below second connecting bend line 468 and bottom edge 416. A curved balloon edge 438 connects top edge 434 and bottom edge 416. Balloon piece 420 is sized such that its width 483 is greater than about 25.4 mm or 1 inch, but less than 50.8 or 2 inches. As illustrated, balloon piece 420 includes printed indicia. Besides price piece 418 being defined by bottom edge 416, base left side edge 467, second connecting bend line 468 and fold 422, price piece 418 is also defined by a right side edge 484.

Right side edge 484 of price piece 418 is in alignment with fold 422 and oriented substantially perpendicular with respect to first and second connecting bend lines 466 and 468. Top edge 434 of balloon piece 420 intersects with right side edge 484 of price piece 418 at an angle 488 that is greater than 90 degrees and less than 180 degrees. At least a portion 490 of top edge 434 of balloon piece 420 can be curved. However, it is also possible that at least a portion 490 of top edge 434 can instead be linear as long as the angle between right side edge 484 and top edge 434 is greater than 90 degrees and less than 180 degrees.

As also illustrated in FIG. 6A, the continuous groove of fold 422 connects to the continuous groove of second connecting bend line 468 by a continuous groove 492. In one embodiment and as illustrated, continuous groove 492 is a linear line connecting fold 422 to second connecting bend line 468. In another embodiment, continuous groove 492 can include a radius of curvature to connect fold 422 to second connecting bend line 468. Such a marking relieves the stress placed on the sheet material between fold 422 and second connecting bend line 468 so that the sheet material does not tear.

Figure 6B:
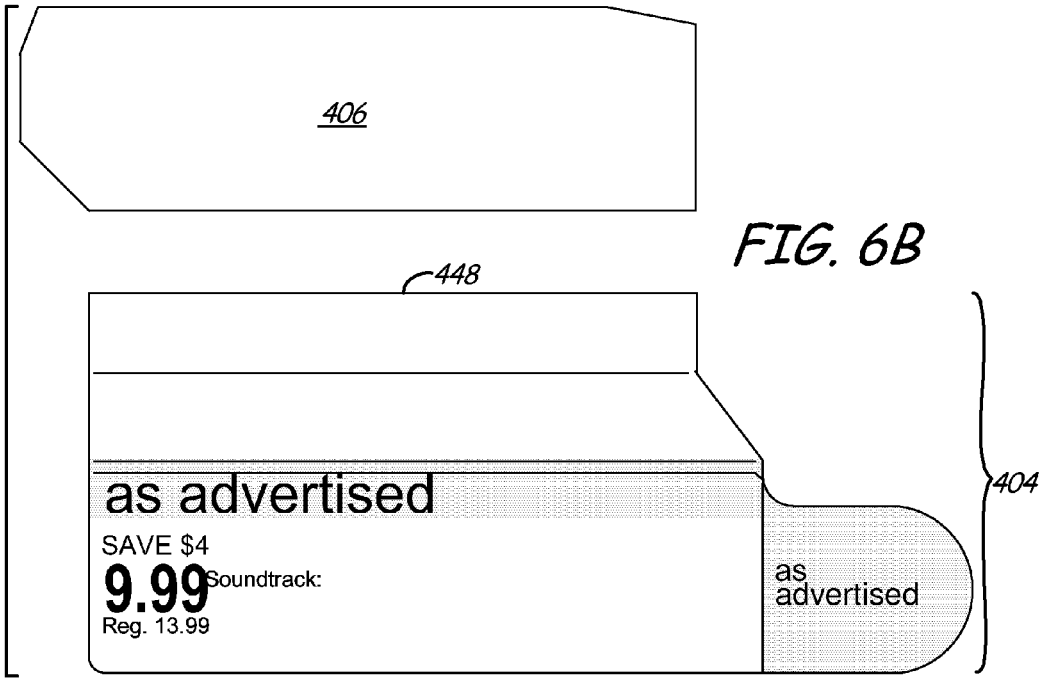
FIG. 6B is a front view of the in-store marketing sign of FIG. 6A with a detached break-away section.

FIG. 6B is a front view of in-store marketing sign 400 of FIG. 6A with the break-away section 406 separated from main section 404. In the store, a user detaches break-away section 406 from main section 404 at score 410 and discards break-away section 406. By detaching break-away section 406, score 410 becomes the top edge 448 of main section 404.

Figure 7A:
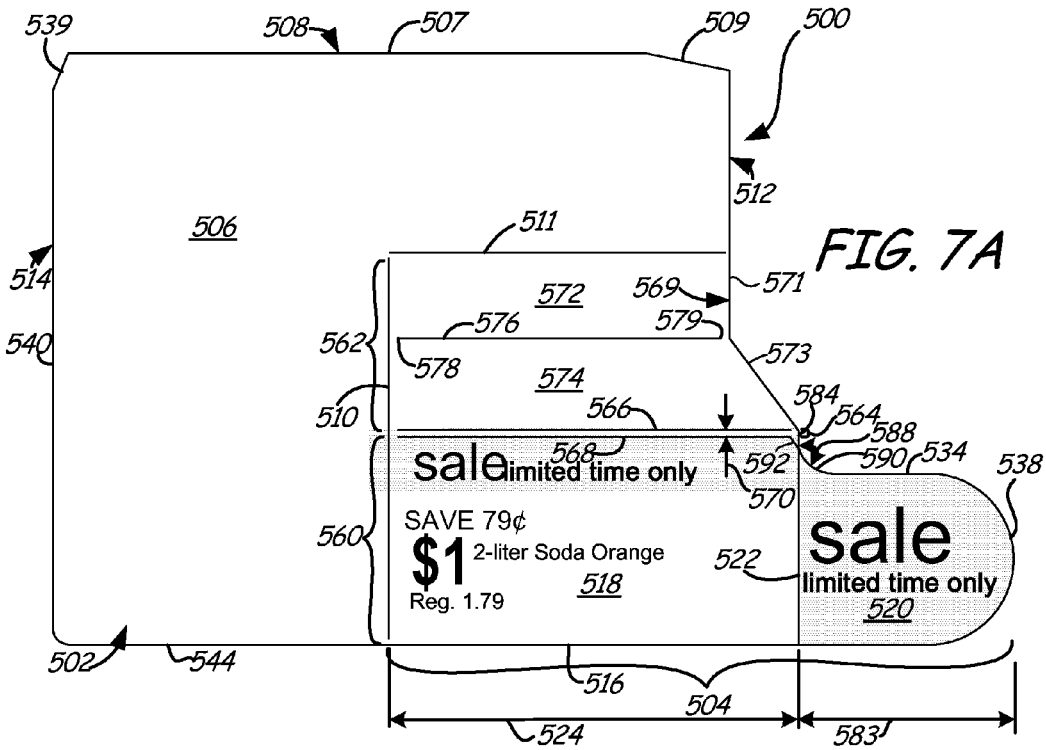
FIG. 7A is a front view of an in-store marketing sign for a shelf-type display structure according to yet another embodiment.

FIG. 7A is a front view of an in-store marketing sign 500 illustrating a front surface 502 according to one embodiment. Marketing sign 500 is also for use with a shelf-type product display structure, such as shelf-type display structure 350, and is made, like marketing signs 100, 200 and 400, with a pliable yet resilient sheet material.

Marketing sign 500 includes a main section or portion 504 and a break-away section or break-off portion 506. Break-away section 506 is coupled to main section 504 by a first score 510 and a second score 511. First score 510 is substantially perpendicular to second score 511.

Break-away section 506 is defined at least by a break-away top edge 508, a break-away bottom edge 544, the first score 510, the second score 511, a break-way right side edge 512 and a break-away left side edge 514. At least a portion of break-away top edge 508, second score 511 and break-away bottom edge 544 are oriented substantially in parallel with each other and at least a portion of break-away right side edge 512, a portion of left side edge 514 and first score 510 are in parallel with each other, while at least a portion of break-away top edge 508 and second score 511 are oriented substantially perpendicular to at least a portion of break-away right side edge 512, break-away left side edge 514 and first score 510.

Break-away top edge 508 includes two different edge sections. The first edge section 507 intersects with a first edge section 539 of break-away left side edge 514 and is substantially in parallel with score 511 and substantially perpendicular to break-away right side edge 512. Second edge section 509 intersects with first edge section 507 at one end and with the break-away right side edge 512 at the other end. Second edge section 509 is oriented about 10 degrees from first edge section 507. The taper of second edge section 509 provides marketing sign 500 with a "bumper." The "bumper" ensures marketing sign 500 is not impeded during travel while the sign is being formed.

Break-away left side edge 514 includes at least two different edge sections. The first edge section 539 intersects with first edge section 507 of break-away top edge 508. First edge section 539 is oriented about 110 degrees from first edge section 507 of break-away top edge 508. This taper, like second edge section 509 of break-away top edge 508, provides marketing sign 500 with a "bumper" that ensures the marketing sign is not impeded during travel while the sign is being formed. The second edge section 540 of break-away left side edge 514 intersects first edge section 539 and is substantially perpendicular to first edge section 507 of break-away top edge 508.

Main section 504 is defined at least by first score 510, second score 511 and a bottom edge 516. Bottom edge 516 is substantially parallel to second score 511 and when connected to break-away section 506 intersects with and is in alignment with break-away bottom edge 544. Main section 504 includes a free portion 560, a base portion 562 and a connecting portion 564, which couples the free portion 560 to the base portion 562. Connecting portion 564 is defined at least between a first connecting bend line 566 spaced apart from a second connecting bend line 568 by a distance 570. For example, distance 570 can be about 2 cm. Base portion 562 is defined by score 510, first connecting bend line 566, a portion of score 511 and a base right side edge 569. Base right side edge 569 includes a first edge section 571 that is in alignment with break-away right side edge 512 when connected to break-away section 506 and a second edge section 573. Base portion 562 includes an engaging piece 572 coupled to a support piece 574 at a base bend line 576. As illustrated in FIG. 7A, base bend line 576 is oriented substantially parallel with the first and second connecting bend lines 566 and 568. In one embodiment, base bend line 576 includes a continuous groove extending from a first end 578 to a second end 579. However, it should be realized, as discussed in regards to other bend lines, base bend line 576 can be other types of suitable markings, such as spaced apart slits or perforations that would aid in bending the sheet material along the marking.

Engaging piece 572 is defined at least between score 511, base bend line 576, a portion of first score 510 and first edge section 571 of base right side edge 569. Support piece 574 is defined at least between first connecting bend line 566, base bend line 576, a portion of first score 510 and second edge section 573 of base right side edge 569. Connecting portion 564 couples support piece 574 of base portion 562 to free portion 560 such that first connecting bend line 566 is adjacent support piece 574 and second connecting bend line 568 is adjacent free portion 560.

Free portion 560 of main section 504 includes a price piece 518 coupled to a balloon piece 520 at a fold or bend 522. Fold 522 includes a continuous groove in the sheet material 502 and intersects substantially perpendicularly with bottom edge 516. However, it should be realized, fold 522 can be other types of markings, such as spaced apart markings, through cuts or a perforated line that would aid in bending the sheet material along the marking.

Price piece 518 is sized such that its width 524 is about 76.2 mm or 3 inches according to one embodiment. As illustrated, price piece 518 includes (along with other information) a printed price, and printed indicia. Balloon piece 520 is defined by at least a top edge 534 spaced below second connecting bend line 568 and bottom edge 516. A curved balloon edge 538 connects top edge 534 and bottom edge 516. Balloon piece 520 of marketing sign 500 is sized such that its width 583 is greater than about 25.4 mm or 1 inch, but less than 50.8 or 2 inches. As illustrated, balloon piece 520 includes printed indicia. Besides price piece 518 being defined by bottom edge 516, first score 510, second connecting bend line 568 and fold 522, price piece 518 is also defined by a right side edge 584.

Right side edge 584 of price piece 518 is in alignment with fold 522 and oriented substantially perpendicular with respect to first and second connecting bend lines 566 and 568. Top edge 534 of balloon piece 520 intersects with right side edge 584 of price piece 518 at an angle 588 that is greater than 90 degrees and less than 180 degrees. At least a portion 590 of top edge 534 of balloon piece 520 can be curved. However, it is also possible that at least a portion 590 of top edge 534 can instead be linear as long as the angle between right side edge 584 and top edge 534 is greater than 90 degrees and less than 180 degrees.

As also illustrated in FIG. 7A, the continuous groove of fold 522 connects to the continuous groove of second connecting bend line 568 by a continuous groove 592. In one embodiment and as illustrated, continuous groove 592 is a linear line connecting fold 522 to second connecting bend line 568. In another embodiment, continuous groove 592 can include a radius of curvature to connect fold 522 to second connecting bend line 568. Such a marking relieves the stress placed on the sheet material between fold 522 and second connecting bend line 568 so that the sheet material does not tear.

Figure 7B:
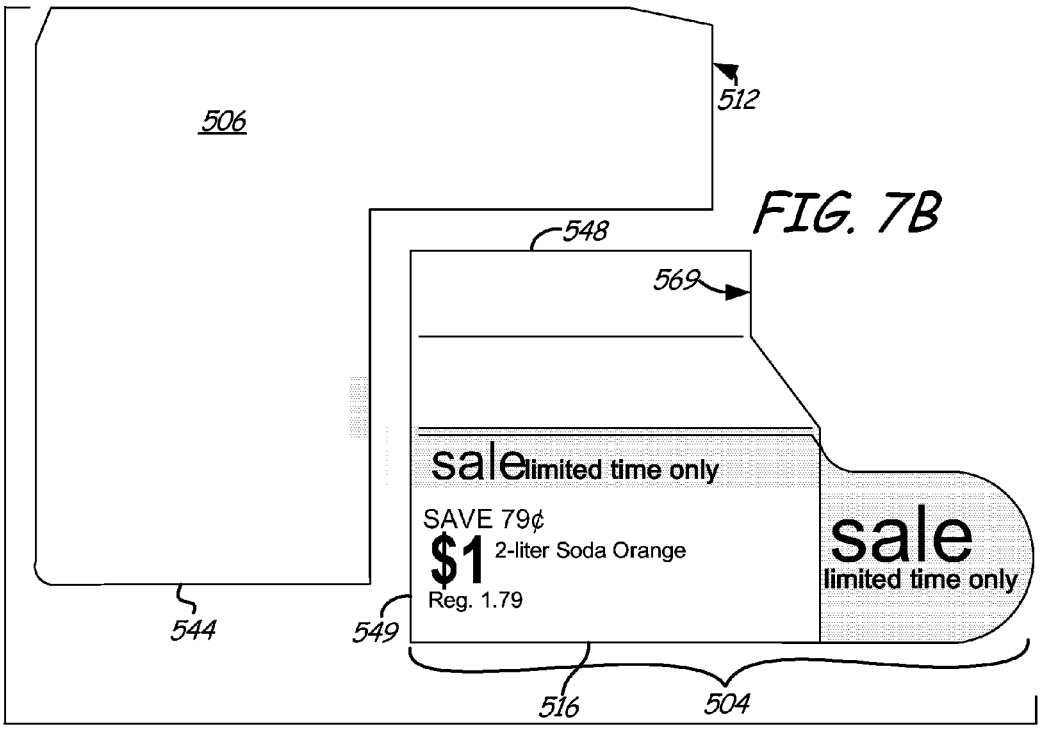
FIG. 7B is a front view of the in-store marketing sign of FIG. 7A with a detached break-away section.

FIG. 7B is a front view of in-store marketing sign 500 illustrated in FIG. 7A with break-away section 506 separated from main section 504. In the store, a user detaches and discards break-away section 506 from main section 504 by separating the bottom edge 544 of break-away section 506 from bottom edge 516 of main section 504 at first score 510, separating break-away right side edge 512 from base right side edge 569 at second score 511 and breaking the tie connecting first score 510 to second score 511. By detaching break-away section 506, first score 510 becomes the left side edge 549 of main section 504 and second score 511 becomes a top edge 548 of main section 504.

Figure 8A:
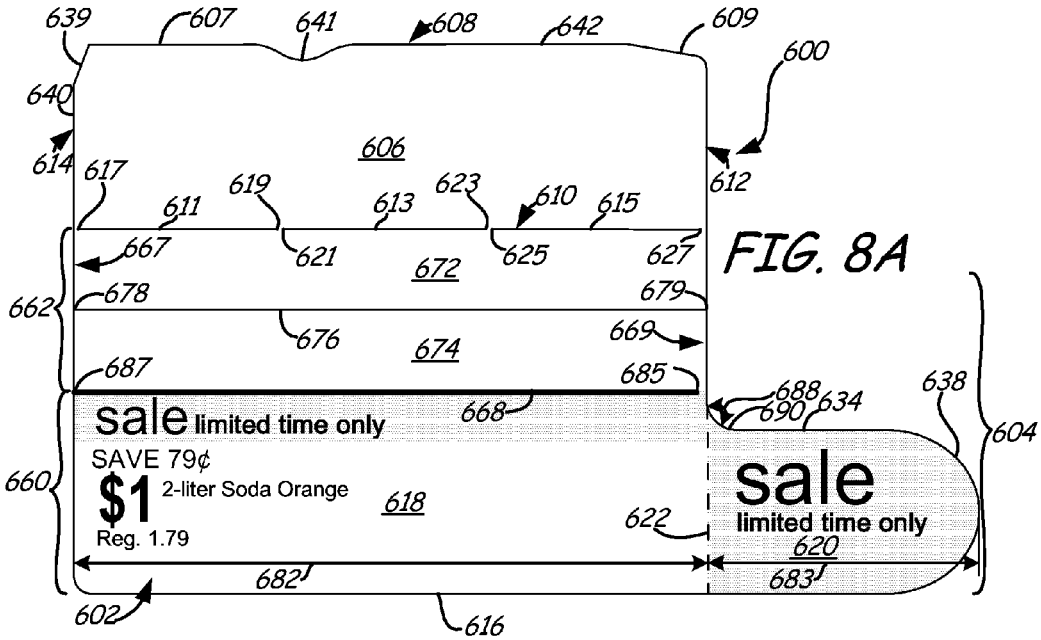
FIG. 8A is a front view of an in-store marketing sign for a shelf-type display structure according to yet another embodiment

FIG. 8A is a front view of an in-store marketing sign 600 illustrating a front surface 602 according to one embodiment. Marketing sign 600 is also for use with a shelf-type product display structure, such as shelf-type display structure 350, and is made, like marketing signs 100, 200, 300, 400 and 500 with a pliable yet resilient sheet material.

Marketing sign 600 includes a main section or portion 604 and a break-away section or break-off portion 606 coupled to the main section 604 by a score 610. As illustrated in FIG. 8A, score 610 is discontinuous and includes three grooves 611, 613 and 615. However, it should be realized, other types of markings are possible. For example, score 610 can include a perforated line, through cuts or combinations thereof. Break-away section 606 is defined at least between a break-away top edge 608, the score 610, a break-away right side edge 612 and a break-away left side edge 614. At least a portion of break-away top edge 608 and score 610 are oriented substantially parallel with each other and at least portions of break-away right and left side edges 612 and 614 are in parallel with each other, while at least a portion of break-away top edge 608 and score 610 are oriented substantially perpendicular to at least portions of break-away right side edge 612 and break-away left side edge 614.

First groove 611 of score 610 includes a first end 617, which is located a spaced distance from left side edge 614. The spaced distance between left side edge 614 and first end 617 is defined as a first tie. First groove 611 includes a second end 619, which is located a spaced distance from a first end 621 of second groove 613. The spaced distance between second end 619 and first end 621 is defined as a second tie. Second groove 613 includes a second end 623, which is located a spaced distance from a first end 625 of third groove 615. The spaced distance between second end 623 and first end 625 is defined as a third tie. Third groove 615 includes a second end 627, which is located a spaced distance from right side edge 612. The spaced distance between right side edge 612 and second end 627 is defined as a fourth tie.

Break-away top edge 608 includes four different edge sections, break-away left side edge 614 includes two different edge sections and break-away right side edge 612 includes a single edge section. The first edge section 639 of break-away left side edge 614 intersects with a first edge section 607 of break-away top edge 608. First edge section 639 is oriented about 110 degrees from first edge section 607 of break-away top edge 608. This taper provides marketing sign 600 with a "bumper" that ensures the marketing sign is not impeded during travel while the sign is being formed. A second edge section 640 is substantially perpendicular to first edge section 607 of break-away top edge 608. Second edge section 640 intersects with and is in alignment with a base left side edge 667 (discussed below) of main section 604 and terminates at or near score 610.

The first edge section 607 of break-away top edge 608 intersects with first edge section 639 of break-away left side edge 614 and is substantially in parallel with score 610 and substantially perpendicular to break-away right side edge 612. Second edge section 641 of break-away top edge 608 is a curved thumb indent. Second edge section 641 or thumb indent intersects first edge section 607 and is placed along break-away top edge 608 to help identify the sign from other sign types that are stacked together in a single stack. Third edge section 642 intersects with second edge section 641 and is substantially parallel with score 610 and substantially perpendicular to break-away right side edge 612. Fourth edge section 609 intersects with third edge section 642 at one end and with the break-away right side edge 612 at the other end. Fourth edge section 609 is oriented about 10 degrees from third edge section 642. The taper of fourth edge section 609 provides marketing sign 600 with a "bumper." The "bumper" ensures marketing sign 600 is not impeded during travel while the sign is being formed.

Main section 604 is defined at least between score 610 and a bottom edge 616 of marketing sign 600, where score 610 is substantially parallel with bottom edge 616. Main section 604 includes a free portion 660, a base portion 662 and a connecting bend line 668. Base portion 662 is defined by score 610, connecting bend line 668, a base left side edge 667 and a base right side edge 669. Base left side edge 667 intersects with and is in alignment with second edge section 640 of break-away left side edge 614 when main section 604 is coupled to break-away section 606. Base right side edge 669 intersects with and is in alignment with break-away right side edge 612 when main section 604 is coupled to break-away section 606. Base portion 662 includes an engaging piece 672 coupled to a support piece 674 at a base bend line 676. As illustrated in FIG. 8A, base bend line 676 is oriented substantially parallel with connecting bend line 668. In one embodiment, base bend line 676 includes a continuous groove extending from base left side edge 667 to base right side edge 669. However, it should be realized, as discussed in regards to other bend lines, base bend line 676 can be other types of suitable markings, such as spaced apart slits or perforations that would aid in bending the sheet material along the marking or a groove having two ends spaced apart from base left side edge 667 and base right side edge 669.

Engaging piece 672 is defined at least between score 610, base bend line 676, base left side edge 667 and base right side edge 669. Support piece 674 is defined at least between connecting bend line 668, base bend line 676, base left side edge 667 and base right side edge 669.

Free portion 660 of main section 604 includes a price piece 618 coupled to a balloon piece 620 at a fold or bend 622. Fold 622 includes a plurality of spaced apart grooves in the sheet material and intersects substantially perpendicularly with bottom edge 616. However, it should be realized, fold 622 can be other types of markings, such as spaced apart perforations or a continuous groove that would aid in bending the sheet material along the marking.

Price piece 618 is sized such that its width 624 is about 127 mm or 5 inches according to one embodiment. As illustrated, price piece 618 includes (along with other information) a printed price and balloon piece 620 includes printed indicia. Balloon piece 620 is defined by at least a top edge 634 spaced below connecting bend line 668. A curved balloon edge 638 connects top edge 634 and bottom edge 616.

Base right side edge 669 of base portion 662 of main section 604 and break-away right side edge 612 of break-away section 606 are in alignment with fold 622 and oriented substantially perpendicular with respect to connecting bend line 668. Top edge 634 of balloon piece 620 intersects with base right side edge 669 at an angle 688 that is greater than 90 degrees and less than 180 degrees. At least a portion 690 of top edge 634 of balloon piece 620 can be curved. However, it is also possible that at least a portion 690 of top edge 634 can instead be linear as long as the angle between base right side edge 669 and top edge 634 is greater than 90 degrees and less than 180 degrees.

Under one embodiment, connecting bend line 668 is a continuous groove that extends from a first end 685 to a second end 687. First end 685 of connecting bend line 668 is located a spaced distance from base right side edge 669 of base portion 662 and second end 687 of connecting bend line 668 intersects with base left side edge 667 of base portion 662.

According to one embodiment and during manufacturing of in-store marketing sign 600, score 610, connecting bend line 668, base bend line 676 and fold 622 are all formed with a laser. In one embodiment, the laser forms score 610 with wider and deeper grooves than the grooves of base bend line 676 and fold 622. However, under this embodiment, the laser forms connecting bend line 668 with the widest and deepest groove (i.e., wider and deeper than the grooves that form score 610, the groove that forms base bend line 676 and the grooves that form fold 622).

Figure 8B:
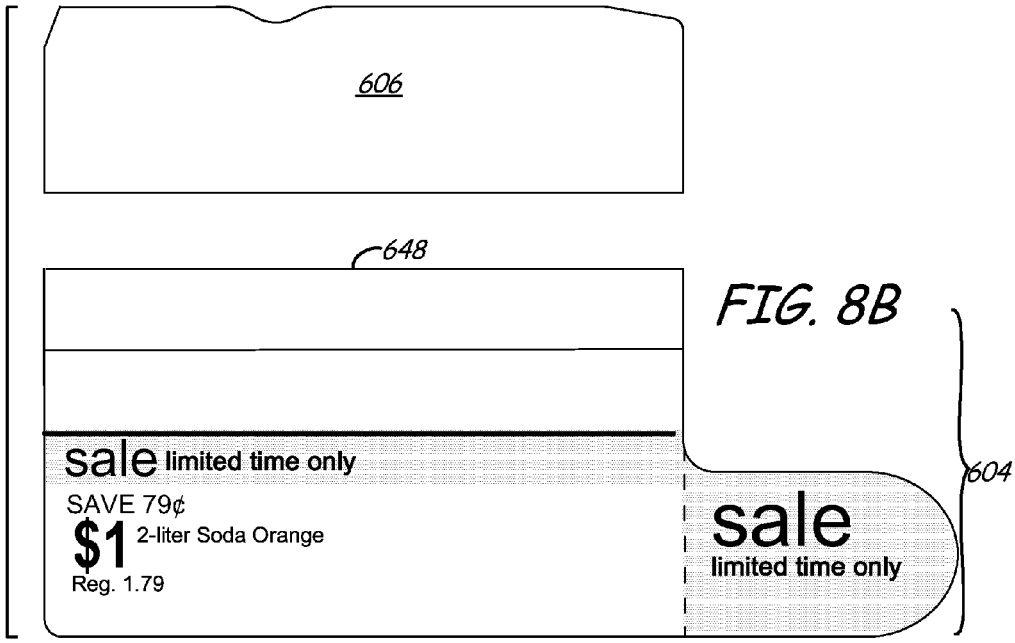
FIG. 8B is a front view of the in-store marketing sign of FIG. 8A with a detached break-away section.

FIG. 8B is a front view of in-store marketing sign 600 of FIG. 8A with the break-away section 606 separated from main section 604. In the store, a user detaches break-away section 606 from main section 604 at score 610 and discards break-away section 606. By detaching break-away section 606, score 610 becomes the top edge 648 of main section 604.

Figure 9A:
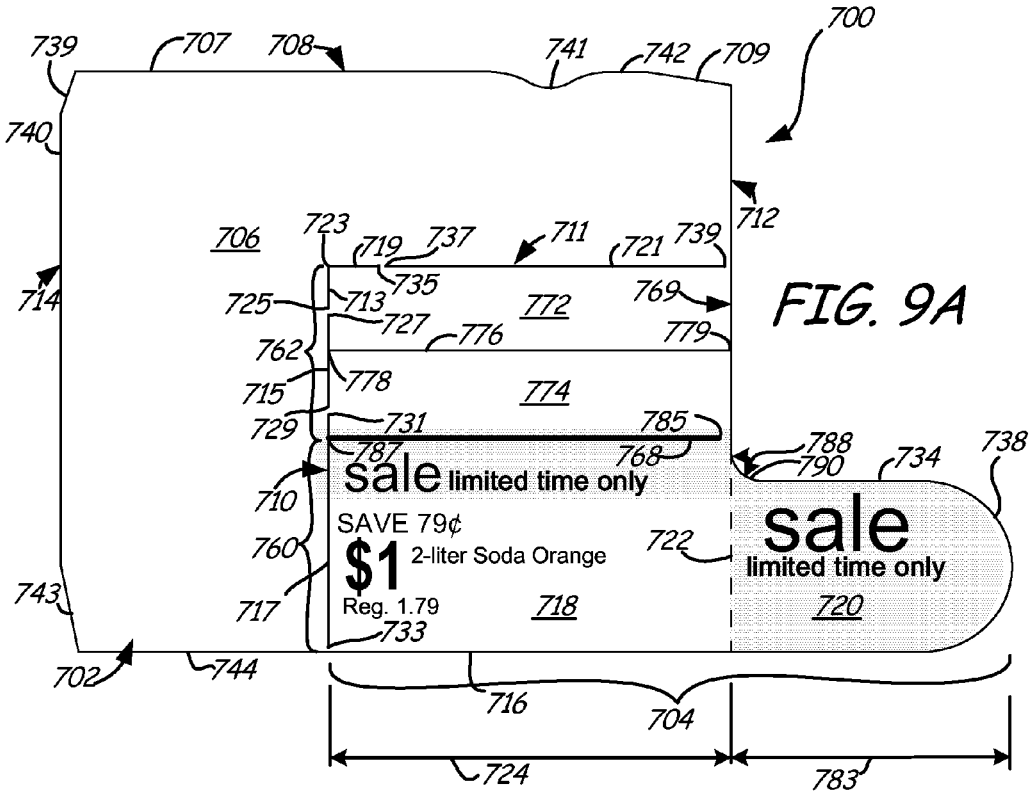
FIG. 9A is a front view of an in-store marketing sign for a shelf-type display structure according to yet another embodiment.
Figure 9B:
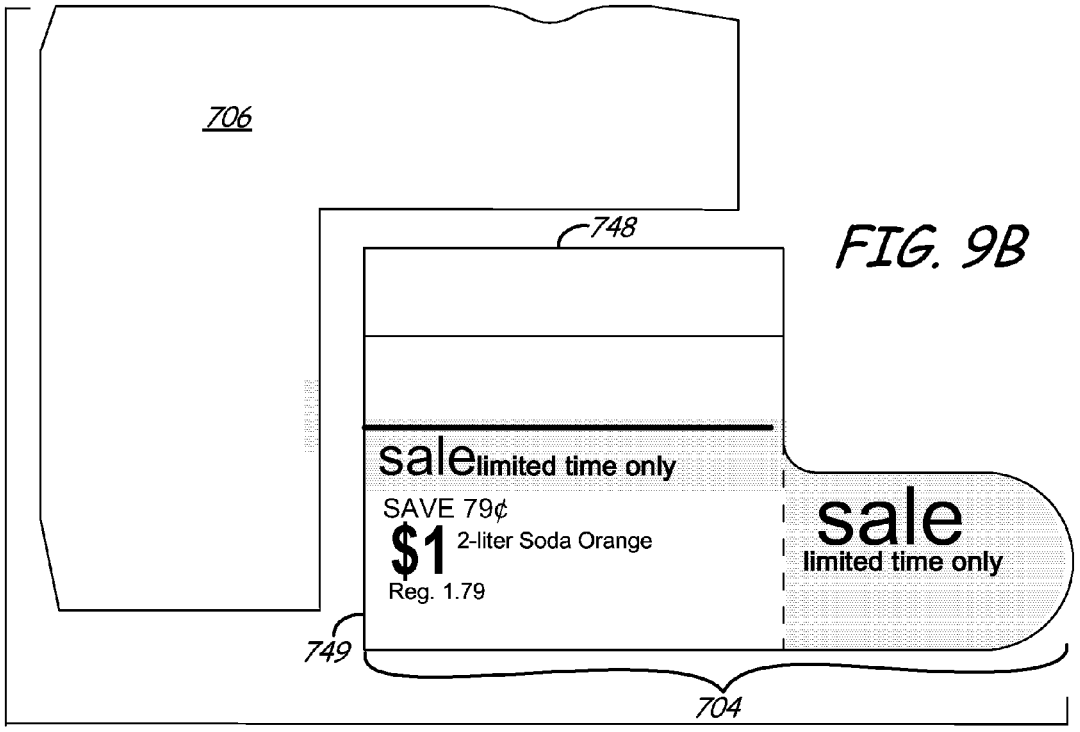
FIG. 9B is a front view of the in-store marketing sign of FIG. 9A with a detached break-away section.

FIG. 9A is a front view of an in-store marketing sign 700 illustrating a front surface 702 according to one embodiment. Marketing sign 700 is also for use with a shelf-type product display structure, such as shelf-type display structure 350, and is made, like marketing signs 100, 200, 400, 500 and 600, with a pliable yet resilient sheet material.

Marketing sign 700 includes a main section or portion 704 and a break-away section or break-off portion 706. Break-away section 706 is coupled to main section 704 by a first score 710 and a second score 711. First score 710 is substantially perpendicular to second score 711.

First score 710 is discontinuous and includes three portions: a first through cut 713, a groove 715 and a second through cut 717. It should be realized, however, that other types of markings are possible. For example, score 710 can include a perforated line, a continuous groove, a through cut or combinations thereof. Second score 711 is discontinuous and includes two portions: a through cut 719 and a groove 721. It should be realized, however, that other types of markings are possible. For example, score 711 can includes a perforated line, a continuous groove, a through cut or combinations thereof.

First through cut 713 of score 710 and through cut 719 of score 711 intersect with each other at first ends or at a point 723. First through cut 713 also includes a second end 725, which is located a spaced distance from a first end 727 of groove 715. The spaced distance between second end 725 of first through cut 713 and first end 727 of groove 715 is defined as a first tie. Groove 715 also includes a second end 729, which is located a spaced distance from a first end 731 of second through cut 717. The spaced distance between second end 729 of groove 715 and first end 731 of second through cut 717 is defined as a second tie. Second through cut 717 of score 710 also includes a second end 733, which is located a spaced distance from a bottom edge 716 of main section 704 of marketing sign 700. The spaced distance between second end 733 and bottom edge 716 is defined as a third tie.

Through cut 719 of score 711 includes a second end 735, which is located a spaced distance from a first end 737 of groove 721. The spaced distance between second end 735 of through cut 719 and first end 737 of groove 721 is defined as a fourth tie. Groove 721 also includes a second end 739, which is located a spaced distance from a base right side edge 769 of a base 762 of main section 704. The spaced distance between second end 739 and base right side edge 769 is defined as a fifth tie.

Break-away section 706 is defined at least by a break-away top edge 708, a break-away bottom edge 744, the first score 710, the second score 711, a break-way right side edge 712 and a break-away left side edge 714. At least a portion of break-away top edge 708, second score 711 and break-away bottom edge 744 are oriented substantially in parallel with each other and at least a portion of break-away right side edge 712, a portion of left side edge 714 and first score 710 are substantially in parallel with each other, while at least a portion of break-away top edge 708 and second score 711 are oriented substantially perpendicular to at least a portion of break-away right side edge 712, break-away left side edge 714 and first score 710.

Break-away top edge 708 includes four different edge sections, break-away left side edge 714 includes three different edge sections and break-away right side edge 712 includes a single edge section. The first edge section 739 of break-away left side edge 714 intersects with a first edge section 707 of break-away top edge 708. First edge section 739 is oriented about 110 degrees from first edge section 707 of break-away top edge 708. This taper provides marketing sign 700 with a "bumper" that ensures the marketing sign is not impeded during travel while the sign is being formed. A second edge section 740 is substantially perpendicular to first edge section 707 of break-away top edge 708 and break-away bottom edge 744. Second edge section 740 intersects with a third edge section 743 of break-away left side edge 714. Third edge section 743 intersects with and is oriented about 110 degrees from break-away bottom edge 744. This taper provides marketing sign 700 with a "bumper" that ensures the marketing sign is not impeded during travel while the sign is being formed.

The first edge section 707 of break-away top edge 708 intersects with first edge section 739 of break-away left side edge 714 and is substantially in parallel with score 711 and substantially perpendicular to break-away right side edge 712. Second edge section 741 of break-away top edge 708 is a curved thumb indent. Second edge section or thumb indent 741 intersects first edge section 707 and is placed along break-away top edge 708 to help identify the sign from other sign types that are stacked together in a single stack. Third edge section 742 of break-away top edge 708 intersects with second edge section 741 and is substantially parallel with score 711 and substantially perpendicular to break-away right side edge 712. Fourth edge section 709 intersects with third edge section 742 at one end and with the break-away right side edge 712 at the other end. Fourth edge section 709 is oriented about 10 degrees from third edge section 742. The taper of fourth edge section 709 provides marketing sign 700 with a "bumper." The "bumper" ensures marketing sign 700 is not impeded during travel while the sign is being formed.

Main section 704 is defined at least by first score 710, second score 711 and a bottom edge 716. Bottom edge 716 is substantially parallel to second score 711 and when connected to break-away section 706 intersects with and is in alignment with break-away bottom edge 744. Main section 704 includes a free portion 760, a base portion 762 and a connecting bend line 768, which couples the free portion 760 to the base portion 762. Base portion 762 is defined by score 710, a portion of score 711 and base right side edge 769. Base portion 762 includes an engaging piece 772 coupled to a support piece 774 at a base bend line 776. As illustrated in FIG. 9A, base bend line 776 is oriented substantially parallel with connecting bend line 768. In one embodiment, base bend line 776 includes a continuous groove extending from a first end 778 to a second end 779. However, it should be realized, as discussed in regards to other bend lines, base bend line 776 can be other types of suitable markings, such as spaced apart slits or perforations that would aid in bending the sheet material along the marking.

Engaging piece 772 is defined at least between score 711, base bend line 776, a portion of first score 710 and base right side edge 769. Support piece 774 is defined at least between connecting bend line 768, base bend line 776, a portion of first score 710 and base right side edge 769.

Free portion 760 of main section 704 includes a price piece 718 coupled to a balloon piece 720 at a fold or bend 722. Fold 722 includes a plurality of spaced apart grooves in the sheet material 702 and intersects substantially perpendicularly with bottom edge 716. However, it should be realized, fold 722 can be other types of markings, such as a continuous groove or perforations that would aid in bending the sheet material along the marking.

Price piece 718 is sized such that its width 724 is about 76.2 mm or 3 inches according to one embodiment. As illustrated, price piece 718 includes (along with other information) a printed price and printed indicia. Balloon piece 720 is defined by at least a top edge 734 spaced below connecting bend line 768 and bottom edge 716. A curved balloon edge 738 connects top edge 734 and bottom edge 716. Balloon piece 720 of marketing sign 700 is sized such that its width 783 is greater than about 50.8 or 2 inches. As illustrated, balloon piece 720 includes printed indicia.

Base right side edge 769 of base portion 762 of main section 704 and break-away right side edge 712 of break-away section 706 is in alignment with fold 722 and oriented substantially perpendicular with respect to connecting bend line 768. Top edge 734 of balloon piece 720 intersects with base right side edge 769 at an angle 788 that is greater than 90 degrees and less than 180 degrees. At least a portion 790 of top edge 734 of balloon piece 720 can be curved. However, it is also possible that at least a portion 790 of top edge 734 can instead be linear as long as the angle between base right side edge 769 and top edge 734 is greater than 90 degrees and less than 180 degrees.

Under one embodiment, connecting bend line 768 is a continuous groove that extends from a first end 785 to a second end 787. A first end 785 of connecting bend line 768 is located a spaced distance from base right side edge 769 of base portion 762 and second end 787 of connecting bend line 768 intersects with first score 710 before break-away section 706 is detached.

According to one embodiment and during manufacturing of in-store marketing sign 700, groove 715 of first score 710, groove 721 of second score 711, connecting bend line 768, base bend line 776 and fold 722 are all formed with a laser. In one embodiment, the laser forms connecting bend line 768 with wider and deeper grooves than the grooves of base bend line 776 and fold 722. However, under this embodiment, the laser forms connecting bend line 768 with the widest and deepest groove (i.e., wider and deeper than the grooves that form score 710, the groove that forms base bend line 776 and the grooves that form fold 722).

FIG. 7B is a front view of in-store marketing sign 700 illustrated in FIG. 7A with break-away section 706 separated from main section 704. In the store, a user detaches and discards break-away section 706 from main section 704 by separating the break-away section 706 from main section 704 at first score 710 (i.e., breaking the first, the second and the third ties along first score 710) and separating the break-away section 706 from main section 704 at second score 711 (i.e., breaking the fourth tie and the fifth tie along second score 711). By detaching break-away section 706 from main section 704, first score 710 becomes the left side edge 749 of main section 704 and second score 711 becomes a top edge 748 of main section 704.

Figure 10:
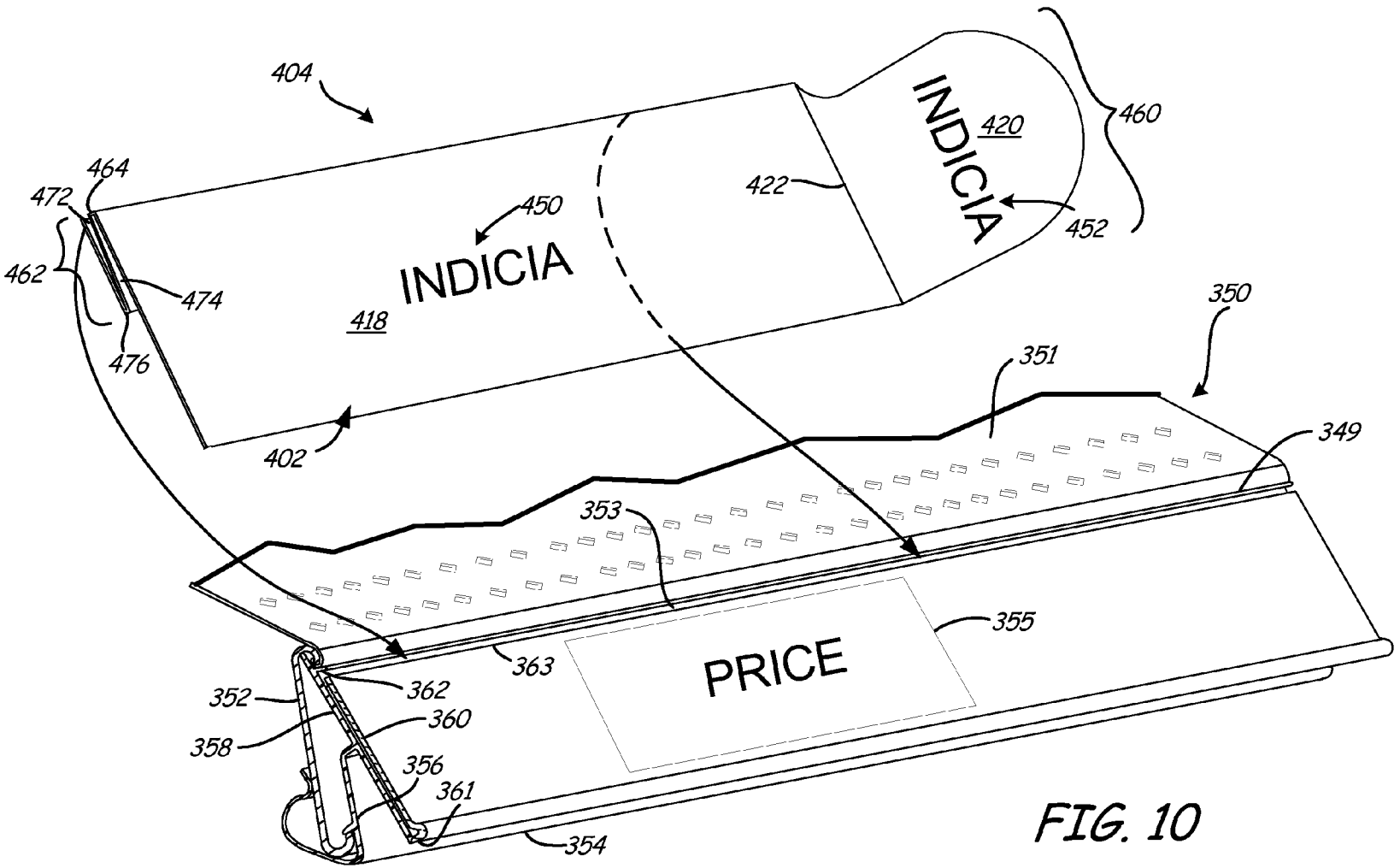
FIG. 10 is a perspective view of the remaining portion of the in-store marketing sign illustrated in FIG. 6B exploded from a perspective sectional view of a shelf-type display structure according to one embodiment.
Figure 11:
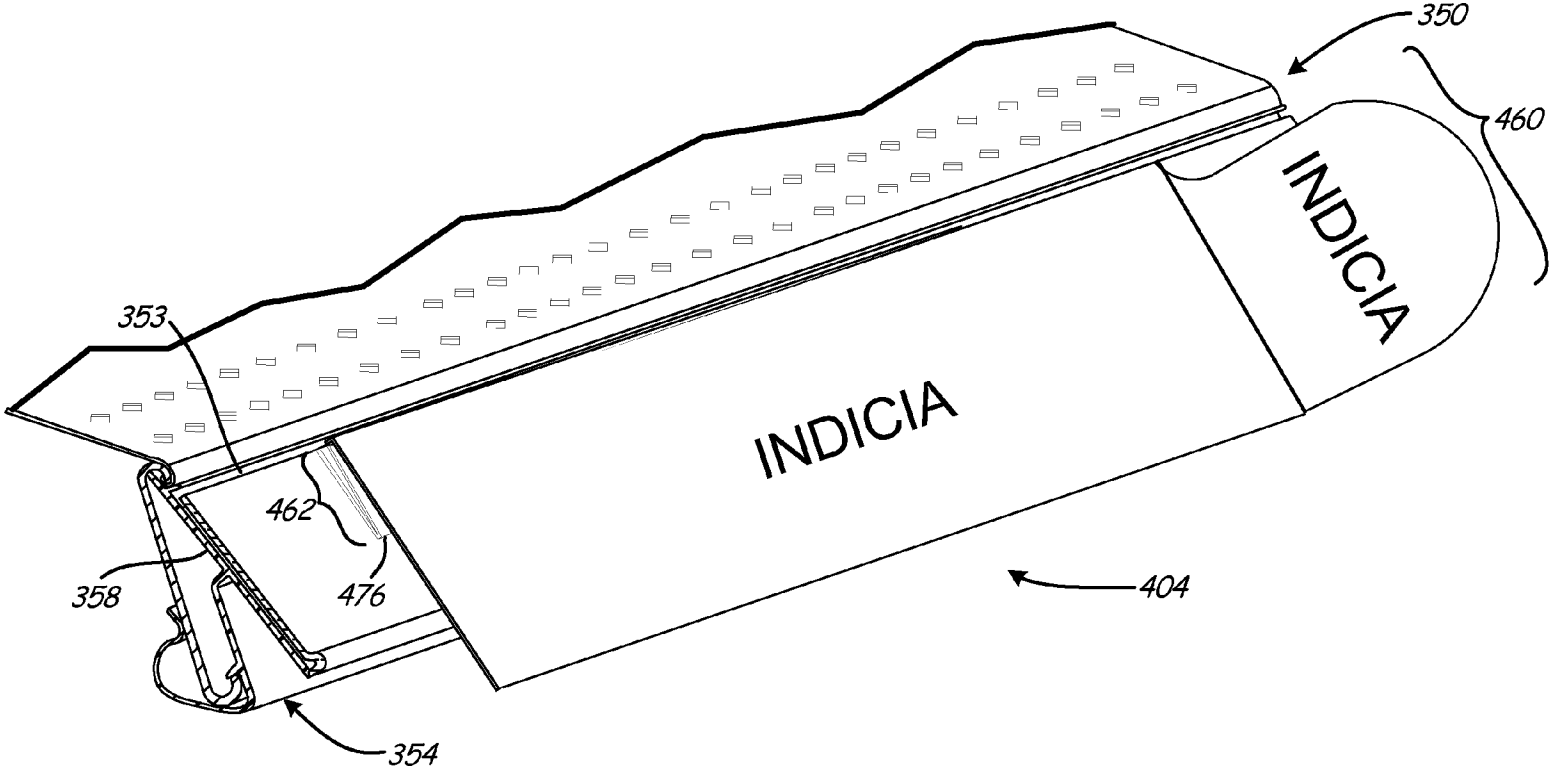
FIG. 11 is a perspective view of the remaining portion of the in-store marketing sign illustrated in FIG. 6B mounted to the perspective sectional view of the shelf-type display structure illustrated in FIG. 11.

FIGS. 10 and 11 are perspective views of the main section 404 of marketing sign 400 illustrated in FIGS. 6A and 6B as exploded from and assembled with a perspective sectional view of shelf-type display structure 350 according to one embodiment. It should be noted that while FIGS. 10 and 11 illustrate main section 404 of marketing sign 400, it should be realized that shelf-type-display structure 350 can also accommodate main section 504 of marketing sign 500 illustrated in FIGS. 7A and 7B, main section 604 of marketing sign 600 and main section 704 of marketing sign 700 in the same way.

In FIG. 10, after break-away section 406 is removed from main section 404, main section 404 is bent at its bend lines. For example, first and second connecting bend lines 466 (not specifically labeled in FIG. 10) and 468 are bent such as to define connecting portion 408, free portion 460 and base portion 462. Base bend line 476 is bent to define engaging piece 472 and support piece 474. As illustrated in FIG. 10, base bend line 476 is folded such that engaging piece 472 is laid against support piece 474. With this fold, support piece 474 is located closer to free portion 460 than engaging piece 472. Free bend line 422 is also bent and oriented out-of-plane from a front surface 402 of price piece 418.

To physically alter price holder 354, folded base portion 462 is inserted between back side 358 and front side 360 of price holder 354 so as to cover the regular price label 355 of price label strip 353. In other words, base portion 462 is configured to engage with or couple to price holder 354, which is coupled to display structure 350.

In one embodiment, price piece 418 includes indicia 450 indicative of a price of a product and product information of which main section 404 of sign 400 is marketing and balloon piece 420 includes indicia 452 indicative of promotional information about the product the main section 404 of sign 400 is marketing. Upon main section 404 of marketing sign 400 covering the regular price label 355, marketing sign indicates a new price with indicia 450 located on price piece 418 and further highlights promotional features of the product with indicia 452 located on balloon piece 420. While indicia 452 are located on a front side of balloon piece 420, indicia are also located on a back side of balloon piece 420 such that indicia on balloon piece 420 are double sided.

FIG. 11 is a perspective view of main section 404 of marketing sign 400 as mounted to a perspective sectional view of shelf-type display structure 350. It should be pointed out, in other embodiments, base portion 462 including engaging piece 472 and support piece 474 can be inserted between back side 358 and front side 360 of price holder 354 and behind price label strip 353. As discussed above, base bend line 476 is folded such that engaging piece 472 is laid against support piece 474. With this fold, support piece 474 is located closer to free portion 460 than engaging piece 472. In such a configuration, base edge 484 (FIG. 6A) can engage with extension 362 of price holder 354 or bull nose 349 of display structure 350 to prevent main section 404 from sliding upward and out of the price holder 354.

Connecting portion 464 (FIG. 6A) defined at least by first and second connecting bend lines 466 and 468, which are spaced apart by distance 470, is sized to correspond with a thickness of the top edge 363 of front side 360. By connecting portion 464 being sized to correspond with a thickness of top edge 363, the top edge 363 is allowed to support main section 404 at first and second connecting bend lines 466 and 468 and be in contact with connecting portion 464.

Figure 12A:
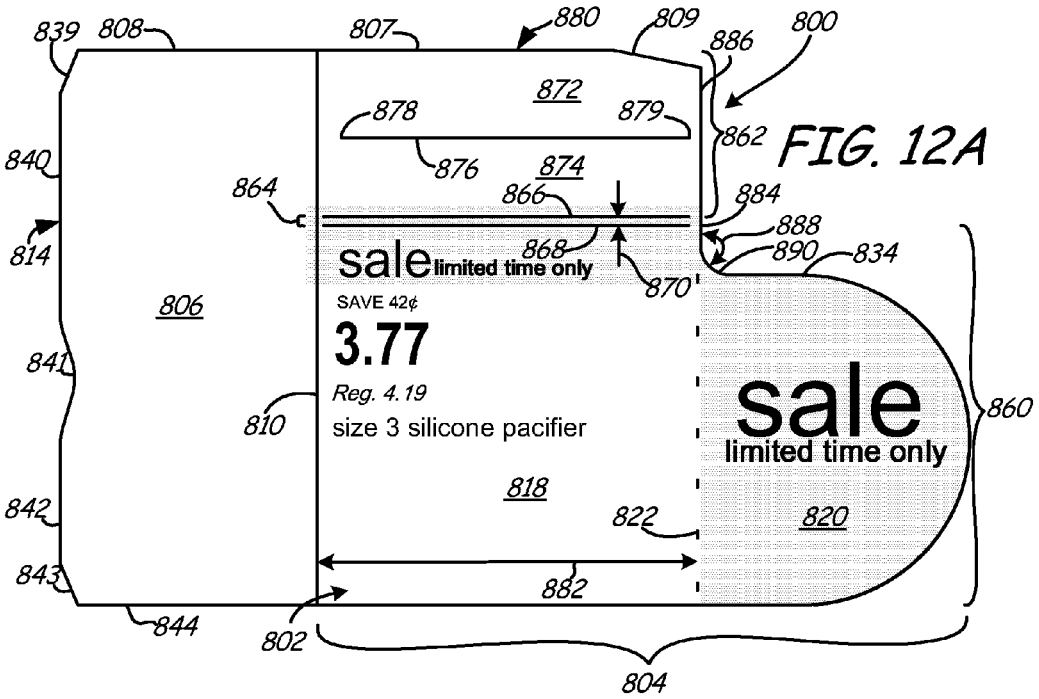
FIG. 12A is a front view of an in-store marketing sign for a shelf-type display structure according to one embodiment.

FIG. 12A is a front view of a marketing sign 800 showing a front surface 802 according to one embodiment. Like marketing signs 100, 200, 300, 400, 500, 600 and 700, marketing sign 800 is formed with a pliable yet resilient sheet material and is for use with a shelf-type product display structure, such as shelf-type display structure 350. Marketing sign 800 includes a main section or portion 804 and a break-away section or break-off portion 806.

Break-away section 806 is coupled to main section 804 by a score 810. As illustrated in FIG. 12A, score 810 is a continuous groove formed in the sheet material. However, it should be realized, other types of markings are possible. For example, score 810 can be a perforated line or a through cut. Break-away section 806 is defined at least by a break-away top edge 808, a break-away bottom edge 844, the score 810 and a break-away left side edge 814. Break-away top edge 808 and break-away bottom edge 844 are substantially parallel with each other, while score 810 and portions of break-away left side edge 814 are oriented substantially perpendicular to break-away top edge 808 and break-away bottom edge 844.

Break-away left side edge 814 includes at least three different edge sections. More particular and in the embodiment illustrated in FIG. 12A, break-away left side edge includes five different edge sections. The first edge section 839 intersects with break-away top edge 808. First edge section 839 is oriented about 110 degrees from break-away top edge 808. This taper provides marketing sign 800 with a "bumper" that ensures the marketing sign is not impeded during travel while the sign is being formed. The second edge section 840 intersects with first edge section 839 and is substantially perpendicular to break-away top edge 808 and break-away bottom edge 844. The third edge section 841 is a curved thumb indent. Third edge section 841 or thumb indent intersects second edge section 840 and is placed along break-away left side edge 814 to help identify the sign from other sign types that are stacked together in a single stack. The fourth edge section 842 intersects with third edge section 841 and is substantially perpendicular to break-away top edge 808 and break-away bottom edge 844. The fifth edge section 843 intersects with fourth edge section 842 at one end and intersects with break-away bottom edge 844 at the other end. Fifth edge section 842 is oriented about 115 degrees from break-away bottom edge 844.

Main section 804 includes a free portion 860, a base portion 862 and a connecting portion 864, which couples the free portion 860 to the base portion 862. Connecting portion 864 is defined at least between a first connecting bend line 866 spaced apart from a second connecting bend line 868 by a distance 870. For example, distance 870 can be about 2 cm. Base portion 862 includes engaging piece 872 coupled to support piece 874 at a base bend line 876. As illustrated in FIG. 11A, base bend line 876 is oriented substantially parallel with the first and second connecting bend lines 866 and 868. In one embodiment, base bend line 876 includes a continuous groove extending from a first end 878 to a second end 879. However, it should be realized, as discussed in regards to other bend lines, base bend line 876 can be other types of suitable markings, such spaced apart slits or perforations that would aid in bending the sheet material along the marking.

Engaging piece 872 is defined at least between a base edge 880 and base bend line 876. Support piece 874 is defined at least between first connecting bend line 866 and base bend line 876. In other words, connecting portion 864 couples support piece 874 of base portion 862 to free portion 860 such that first connecting bend line 866 is adjacent support piece 874 and second connecting bend line 868 is adjacent free portion 860.

Base edge 880 includes two different edge sections. The first edge section 807 intersects with and is substantially perpendicular with score 810. The second edge section 809 intersects with first edge section 807 at one end and with side edge 886 of base portion 862 at the other end. Second edge section 809 is oriented about 10 degrees from first edge section 807. The taper of second edge section 809 provides marketing sign 800 with a "bumper." The "bumper" ensures marketing sign 800 is not impeded during travel while the sign is being formed.

Like marketing signs 100, 200, 300, 400 500, 600 and 700, the free portion 860 of main section 804 includes a price piece 818 coupled to a balloon piece 820 at a fold or bend 822. Fold 822 includes spaced apart markings that can be grooves or through cuts. For example, each of the plurality of markings can extend for a length of about 2 cm and each marking can be spaced apart from each other by a distance of about 7 cm. Such a distance provides a resilient connection between price piece 818 and balloon piece 820 while still allowing fold 822 to bend. However, it should be realized, as discussed in regards to other bend lines, fold 822 can have markings spaced apart from each other at other distances. In addition, fold 822 can be other types of markings, such as a continuous score or a perforated line that would aid in bending the sheet material along the marking.

Price piece 818 is sized such that its width 882 is about 76.2 mm or 3 inches according to one embodiment. As illustrated, price piece 818 includes (along with other information) a printed price and balloon piece 820 includes a printed indicia. Balloon piece 820 includes a top edge 834 spaced below second connecting bend line 868. Price piece 818 includes a first side edge 884 in alignment with side edge 886 of base portion 862. First side edge 884 of price piece 818 is oriented substantially perpendicular with respect to first and second connecting bend lines 866 and 868. Top edge 834 of balloon piece 820 intersects with first side edge 884 of price piece 818 at an angle 888 that is greater than 90 degrees and less than 180 degrees. At least a portion 890 of top edge 834 of balloon piece 820 can be curved. However, it is also possible that at least a portion 890 of top edge 834 can instead be linear as long as the angle between first side edge 884 and top edge 834 is greater than 90 degrees and less than 180 degrees.

Figure 12B:
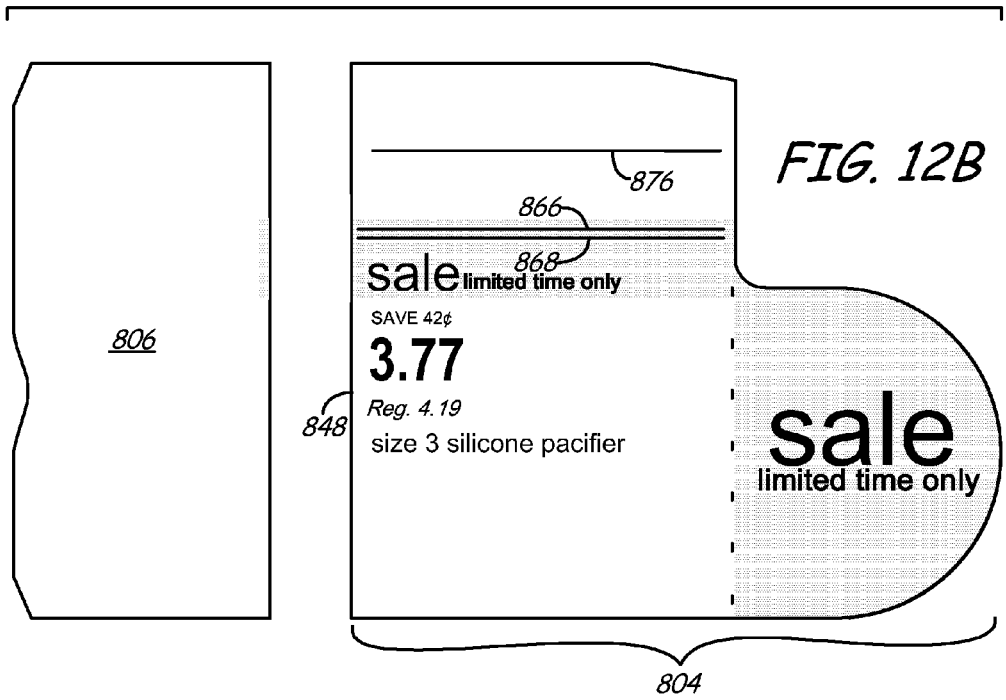
FIG. 12B is a front view of the in-store marketing sign of FIG. 12A with a detached break-away section.

FIG. 12B is a front view of in-store marketing sign 800 of FIG. 12A with the break-away section 806 separated from main section 804. In the store, a user detaches break-away section 806 from main section 804 at score 810 (FIG. 11A) and discards break-away section 806. By detaching break-away section 806, score 810 becomes the left side edge 848 of main section 804, which is substantially perpendicular to first connecting bend line 866, second connecting bend line 868 and base bend line 876.

Figure 13A:
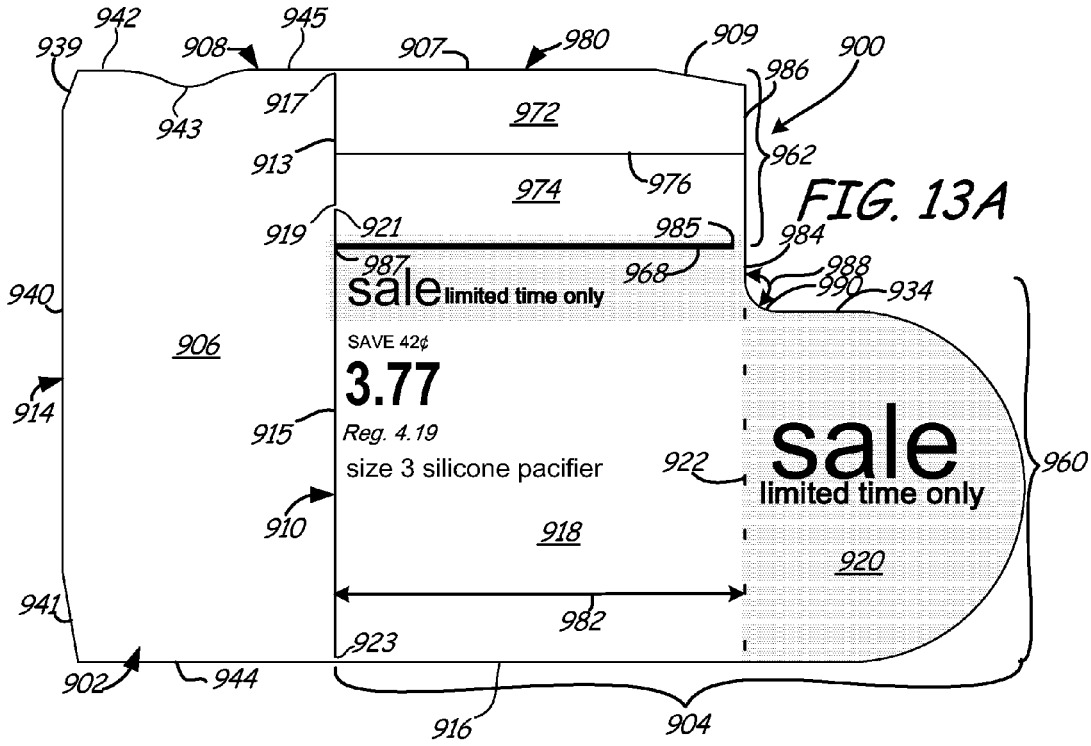
FIG. 13A is a front view of an in-store marketing sign for a shelf-type display structure according to another embodiment.

FIG. 13A is a front view of a marketing sign 900 showing a front surface 902 according to one embodiment. Like marketing signs 100, 200, 300, 400, 500, 600, 700 and 800, marketing sign 900 is formed with a pliable yet resilient sheet material and is for use with a shelf-type product display structure, such as shelf-type display structure 350. Marketing sign 900 includes a main section or portion 904 and a break-away section or break-off portion 906.

Break-away section 906 is coupled to main section 904 by a score 910. As illustrated in FIG. 13A, score 910 is discontinuous and includes two portions: a first groove 913 and a second groove 915. It should be realized, however, that other types of markings are possible. For example, score 910 can include a perforated line, a continuous groove, a through cut or combinations thereof. First groove 913 includes a first end 917 and a second end 919. First end 917 is located a spaced distance from break-away top edge 908 and base edge 980. This spaced distance is defined as a first tie. Second end 919 of first groove 913 is located a spaced distance from a first end 921 of second groove 915. This spaced distance is defined as a second tie. A second end 923 of second groove 915 is located a spaced distance away from break-away bottom edge 944 and a bottom edge 916 of main section 904. This spaced distance is defined as a third tie. The second tie is located along a base portion 962 of main section 904. More specifically, the second tie is located above a connecting bend line 968, but below a base bend line 976.

Break-away section 906 is defined at least by a break-away top edge 908, a break-away bottom edge 944, the score 910 and a break-away left side edge 914. Break-away top edge 908 includes three different edge sections. First edge section 942 and third edge section 945 are substantially parallel with break-away bottom edge 944. Second edge section 943 is a curved thumb indent. Second edge section or thumb indent 943 intersects with first edge section 942 and third edge section 945 and is placed along break-away top edge 908 to help identify the sign from other sign types that are stacked together in a single stack. Score 910 and portions of break-away left side edge 914 are oriented substantially perpendicular to first edge section 942 and third edge section 945 of break-away top edge 908 and to break-away bottom edge 944.

Break-away left side edge 914 includes at least three different edge sections. The first edge section 939 intersects with first edge section 942 of break-away top edge 908. First edge section 939 is oriented about 110 degrees from first edge section 942. This taper provides marketing sign 900 with a "bumper" that ensures the marketing sign is not impeded during travel while the sign is being formed. The second edge section 940 intersects with first edge section 939 and is substantially perpendicular to first edge section 942 and third edge section 945 of break-away top edge 908 and to break-away bottom edge 944. The third edge section 941 intersects with second edge section 940 at one end and intersects with break-away bottom edge 944 at the other end. Third edge section 941 is oriented about 115 degrees from break-away bottom edge 944.

Main section 904 includes a free portion 960 and base portion 962 coupled to the free portion by connecting bend line 968. Base portion 962 includes engaging piece 972 coupled to support piece 974 at a base bend line 976. As illustrated in FIG. 13A, base bend line 976 is oriented substantially parallel with connecting bend line 968. In one embodiment, base bend line 976 includes a continuous groove extending from score 910 to a right side edge 986 of base 962. However, it should be realized, as discussed in regards to other bend lines, base bend line 976 can be other types of suitable markings, such as spaced apart slits or perforations that would aid in bending the sheet material along the marking.

Engaging piece 972 is defined at least between a base edge 980 and base bend line 976. Support piece 974 is defined at least between connecting bend line 968 and base bend line 976. Base edge 980 includes two different edge sections. The first edge section 907 intersects with break-away top edge 908 when main section 904 and break-away section 906 are attached and is substantially perpendicular with score 910. The second edge section 909 intersects with first edge section 907 at one end and with right side edge 986 of base portion 962 at the other end. Second edge section 909 is oriented about 10 degrees from first edge section 907. The taper of second edge section 909 provides marketing sign 900 with a "bumper." The "bumper" ensures marketing sign 900 is not impeded during travel while the sign is being formed.

Like marketing signs 100, 200, 300, 400, 500, 600, 700 and 800, the free portion 960 of main section 904 includes a price piece 918 coupled to a balloon piece 920 at a fold or bend 922. Fold 922 includes spaced apart markings that can be grooves or through cuts. For example, each of the plurality of markings can extend for a length of about 2 cm and each marking can be spaced apart from each other by a distance of about 7 cm. Such a distance provides a resilient connection between price piece 918 and balloon piece 920 while still allowing fold 922 to bend. However, it should be realized, as discussed in regards to other bend lines, fold 922 can have markings spaced apart from each other at other distances. In addition, fold 922 can be other types of markings, such as a continuous score or a perforated line that would aid in bending the sheet material along the marking.

Price piece 918 is sized such that its width 982 is about 76.2 mm or 3 inches according to one embodiment. As illustrated, price piece 918 includes (along with other information) a printed price and balloon piece 920 includes a printed indicia. Balloon piece 920 includes a top edge 934 spaced below connecting bend line 968. Price piece 918 includes a first side edge 984 in alignment with side edge 986 of base portion 962. First side edge 984 of price piece 918 is oriented substantially perpendicular with respect to connecting bend line 968. Top edge 934 of balloon piece 920 intersects with first side edge 984 of price piece 918 at an angle 988 that is greater than 90 degrees and less than 180 degrees. At least a portion 990 of top edge 934 of balloon piece 920 can be curved. However, it is also possible that at least a portion 990 of top edge 934 can instead be linear as long as the angle between first side edge 984 and top edge 934 is greater than 90 degrees and less than 180 degrees.

Under one embodiment, connecting bend line 968 is a continuous groove that extends from a first end 985 to a second end 987. A first end 985 of connecting bend line 968 is located a spaced distance from right side edge 986 of base portion 962 and second end 987 of connecting bend line 968 intersects with score 910.

According to one embodiment and during manufacturing of in-store marketing sign 900, first and second grooves 913 and 915 of first score 910, connecting bend line 968, base bend line 976 and fold 922 are all formed with a laser. In one embodiment, the laser forms first groove 913 and second groove 915 of score 910 with wider and deeper grooves than the grooves of base bend line 976 and fold 922. In addition and under this embodiment, the laser forms connecting bend line 968 with a triple laser pass. In other words, the laser carves three grooves adjacent to each other to form connecting bend line 968. This triple laser pass allows sign 900 to be formed without spaced apart connecting bend lines as is the case in the embodiment illustrated in FIGS. 12A and 12B.

Figure 13B:
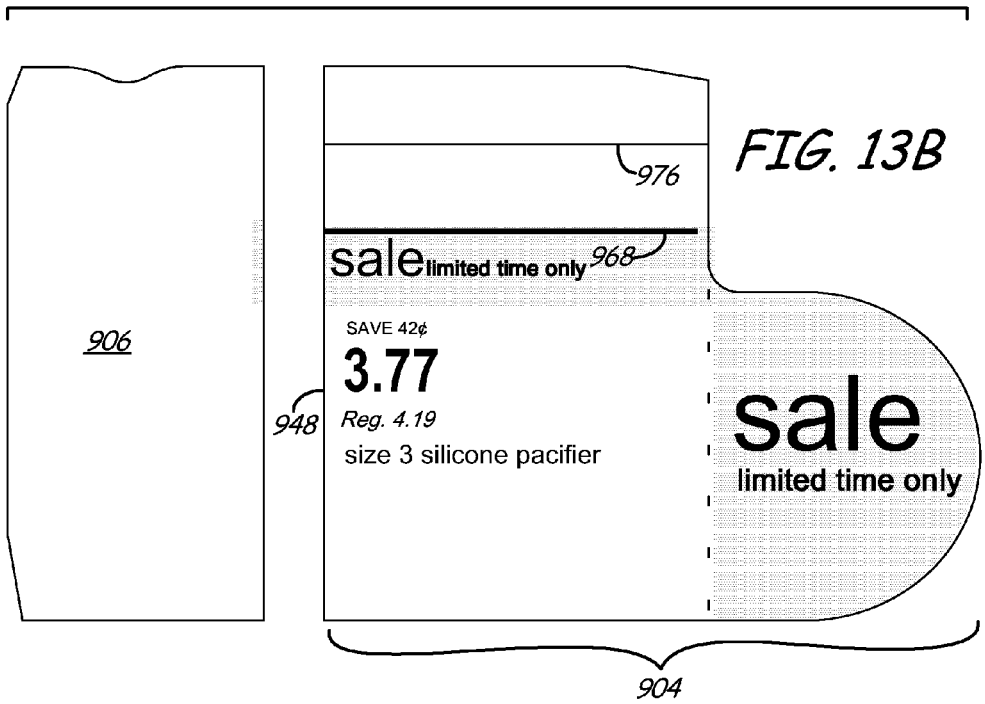
FIG. 13B is a front view of the in-store marketing sign of FIG. 13A with a detached break-away section.

FIG. 13B is a front view of in-store marketing sign 900 of FIG. 13A with the break-away section 906 separated from main section 904. In the store, a user detaches break-away section 906 from main section 904 at score 910 (FIG. 13A) and discards break-away section 906. By detaching break-away section 906, score 910 becomes the left side edge 948 of main section 904, which is substantially perpendicular to connecting bend line 968 and base bend line 976.

Figure 14:
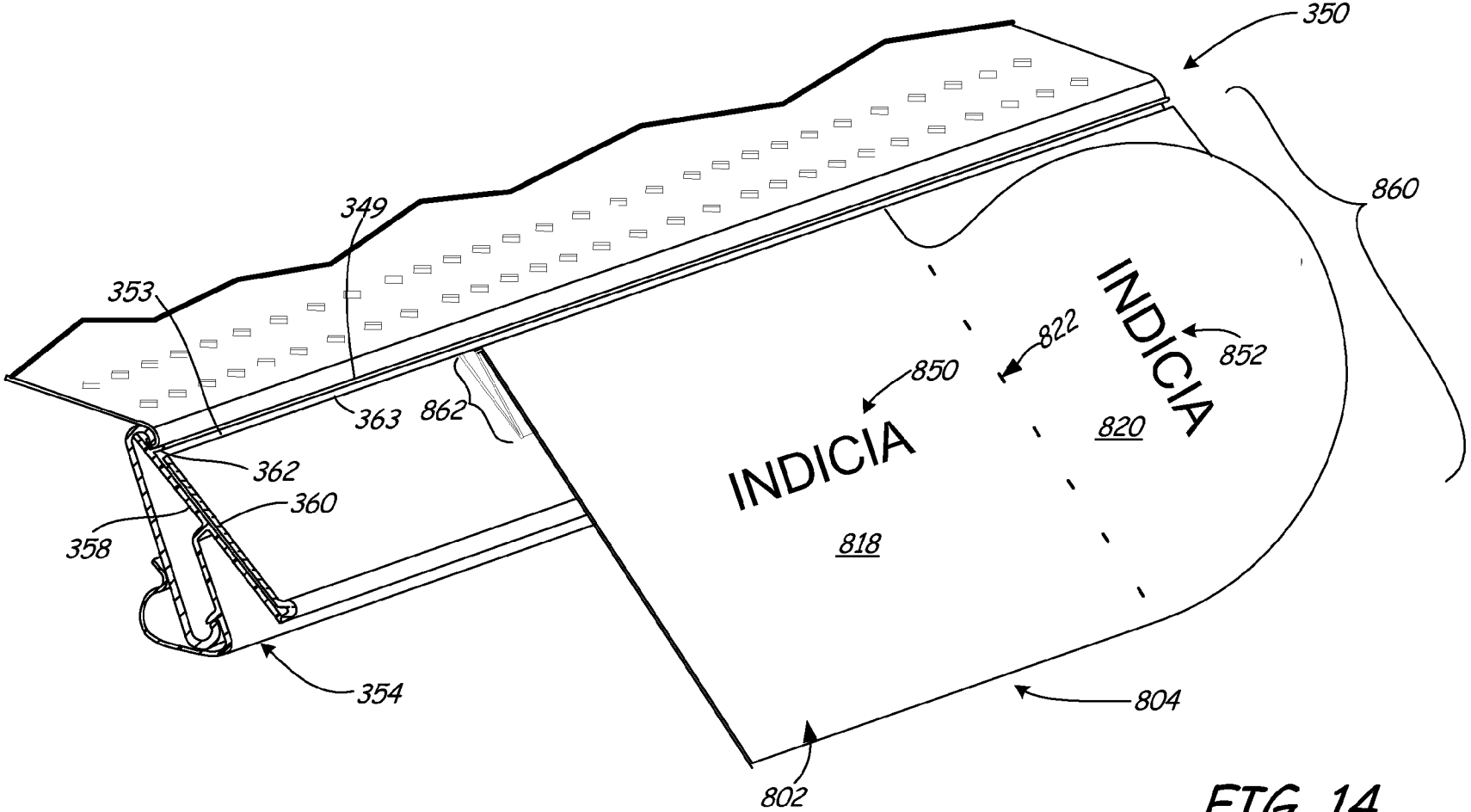
FIG. 14 is a perspective view of the remaining portion of the in-store marketing sign illustrated in FIG. 12B mounted to the perspective sectional view of a shelf-type display structure according to one embodiment.

FIG. 14 is a perspective view of main section 804 of marketing sign 800 as mounted to a perspective sectional view of shelf-type display structure 350. While FIG. 14 illustrates main section 804 of marketing sign 800, shelf type display structure 350 can also accommodate main section 904 of marketing sign 900 illustrated in FIGS. 13A and 13B in the same way. After break-away section 806 is removed from main section 804, marketing sign 800 is bent at fold 822 and balloon piece is oriented out-of-plane from front surface 802 of price piece 818. To physically alter price holder 354 and as illustrated in FIG. 14, base portion 862 (FIG. 12A) including folded engaging piece 872 (FIG. 12A) and support piece 874 (FIG. 12A) of marketing sign 800 are inserted between back side 358 and front side 360 of price holder 354 and in front of price label strip 353. It should be pointed out, in other embodiments, base portion 862 including engaging piece 872 and support piece 874 of marketing sign 400 are inserted between back side 358 and front side 360 of price holder 354 and behind price label strip 353. As discussed above, base bend line 876 is folded such that engaging piece 872 is laid against support piece 874. With this fold, support piece 874 is located closer to free portion 860 (FIG. 12A) than engaging piece 872. In such a configuration, base edge 880 (FIG. 12A) can engage with extension 362 of price holder 354 or bull nose 349 of display structure 350 to prevent marketing sign 400 from sliding upward and out of the price holder 354.

Connecting portion 864 (FIG. 12A) defined at least by first and second connecting bend lines 866 and 868, which are spaced apart by distance 870, is sized to correspond with a thickness of the top edge 363 of front side 360. By connecting portion 864 being sized to correspond with a thickness of top edge 363, the top edge 363 is allowed to support marketing sign 800 at first and second connecting bend lines 866 and 868 and be in contact with connecting portion 864.

In one embodiment, price piece 818 includes indicia 850 indicative of a price of a product and product information for the product that sign 400 is marketing and balloon piece 820 includes indicia 852 indicative of promotional information about the product the sign 800 is marketing. Indicia are also located on a back side of balloon piece 820 (not specifically illustrated) such that indicia on balloon piece 820 are double sided. Upon marketing sign 800 covering the regular price label 355 (FIGS. 3 and 10), marketing sign 800 indicates a new price with indicia 850 located on price piece 818 and further highlights promotional features of the product with indicia 852 located on balloon piece 820.

Figure 15A:
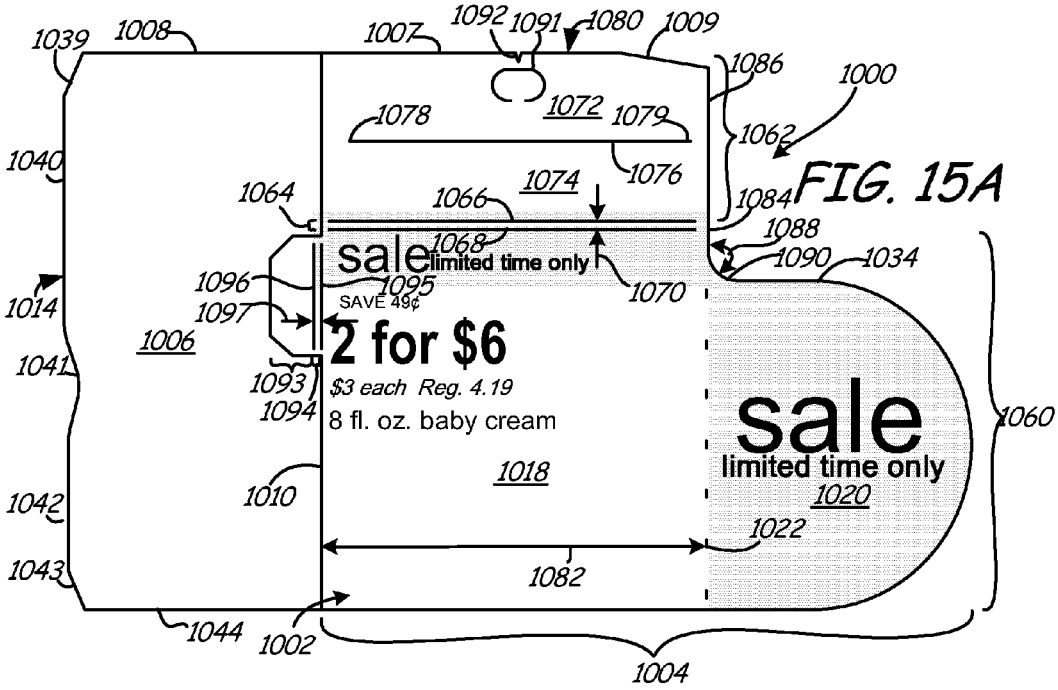
FIG. 15A is a front view of an in-store marketing sign for a peg-type display structure according to one embodiment.

FIG. 15A is a front view of a marketing sign 1000 showing a front surface 1002 according to one embodiment. Like marketing signs 800 and 900, marketing sign 1000 is formed with a pliable yet resilient sheet material. Unlike marketing signs 800 and 900, marketing sign 1000 is for use with a peg-type product display structure. Marketing sign 1000 includes a main section 1004 and a break-away section 1006.

Break-away section 1006 is coupled to main section 1004 by a score 1010. As illustrated in FIG. 15A, a majority of score 1010 is a continuous groove formed in the sheet material. However, it should be realized, other types of markings are possible. For example, the majority of score 1010 could be perforations. Break-away section 1006 is defined at least by a break-away top edge 1008, a break-away bottom edge 1044, the score 1010 and a break-away left side edge 1014. Break-away top edge 1008 and break-away bottom edge 1044 are substantially parallel with each other, while portions of score 1010 and portions of break-away left side edge 1014 are oriented substantially perpendicular to break-away top edge 1008 and break-away bottom edge 1044.

Break-away left side edge 1014 includes at least three different edge sections. More particular and in the embodiment illustrated in FIG. 15A, break-away left side edge includes five different edge sections. The first edge section 1039 intersects with break-away top edge 1008. First edge section 1039 is oriented about 110 degrees from break-away top edge 1008. This taper provides marketing sign 1000 with a "bumper" that ensures the marketing sign is not impeded during travel while the sign is being formed. The second edge section 1040 intersects with first edge section 1039 and is substantially perpendicular to break-away top edge 1008 and break-away bottom edge 1044. The third edge section 1041 is a curved thumb indent. Third edge section 1041 or thumb indent intersects second edge section 1040 and is placed along break-away left side edge 1014 to help identify the sign from other sign types. The fourth edge section 1042 intersects with third edge section 1041 and is substantially perpendicular to break-away top edge 1008 and break-away bottom edge 1044. The fifth edge section 1043 intersects with fourth edge section 1042 at one end and intersects with break-away bottom edge 1044 at the other end. Fifth edge section 1042 is oriented about 115 degrees from break-away bottom edge 1044.

Main section 1004 includes a free portion 1060, a base portion 1062 and a connecting portion 1064, which couples the free portion 1060 to the base portion 1062. Connecting portion 1064 is defined at least between a first connecting bend line 1066 and a second connecting bend line 1068 that are spaced apart by a distance 1070. For example, distance 1070 can be about 2 cm. Base portion 1062 includes engaging piece 1072 coupled to support piece 1074 at a base bend line 1076. As illustrated in FIG. 15A, base bend line 1076 is oriented substantially parallel with the first and second connecting bend lines 1066 and 1068. In one embodiment, base bend line 1076 includes a continuous groove extending from a first end 1078 to a second end 1079. However, it should be realized, as discussed in regards to other bend lines, base bend line 1076 can be other types of suitable markings, such as spaced apart slits, a score or perforations that would aid in bending the sheet material along the marking.

Engaging piece 1072 is defined at least between a base edge 1080 and base bend line 1076. Support piece 1074 is defined at least between first connecting bend line 1066 and base bend line 1076. In other words, connecting portion 1064 couples support piece 1074 of base portion 1062 to free portion 1060 such that first connecting bend line 1066 is adjacent support piece 1074 and second connecting bend line 1068 is adjacent free portion 1060.

Base edge 1080 includes two different edge sections. The first edge section 1007 intersects with and is substantially perpendicular with the majority of score 1010. The second edge section 1009 intersects with first edge section 1007 at one end and with side edge 1086 of base portion 1062 at the other end. Second edge section 1009 is oriented about 10 degrees from first edge section 1007. The taper of second edge section 1009 provides marketing sign 1000 with a "bumper." The "bumper" ensures marketing sign 1000 is not impeded during travel while the sign is being formed.

Like marketing sign 800, the free portion 1060 of main section 1004 includes a price piece 1018 coupled to a balloon piece 1020 at a fold or bend 1022. As illustrated, price piece 1018 includes (along with other information) a printed price and balloon piece 1020 includes a printed indicia. Fold 1022 includes spaced apart markings that can be grooves or through cuts. For example, each of the plurality of markings can extend for a length of about 2 cm and each marking can be spaced apart from each other by a distance of about 7 cm. Such a distance provides a resilient connection between price piece 1018 and balloon piece 1020 while still allowing fold 1022 to bend. However, it should be realized, as discussed in regards to other bend lines, fold 1022 can have markings spaced apart from each other at other distances. In addition, fold 1022 can be other types of markings, such as a continuous or a perforated line that would aid in bending the sheet material along the marking.

Price piece 1018 is sized such that its width 1082 is about 76.2 mm or 3 inches according to one embodiment. Balloon piece 1020 includes a top edge 1034 spaced below second connecting bend line 1068. Price piece 1018 includes a first side edge 1084 in alignment with side edge 1086 of base portion 1062. First side edge 1084 of price piece 1018 is oriented substantially perpendicular with respect to first and second connecting bend lines 1066 and 1068. Top edge 1034 of balloon piece 1020 intersects with first side edge 1084 of price piece 1018 at an angle 1088 that is greater than 90 degrees and less than 180 degrees. At least a portion 1090 of top edge 1034 of balloon piece 1020 can be curved. However, it is also possible that at least a portion 1090 of top edge 1034 can instead be linear as long as the angle between first side edge 1084 and top edge 1034 is greater than 90 degrees and less than 180 degrees.

Unlike marketing sign 800, engaging piece 1072 of base portion 1062 includes a circular through cut 1091. For example, the center of circular through cut 1091 is spaced from a side edge 1086 of base portion 1062 such that circular through cut 1091 is centered between break-away score 1010 and side edge 1086. However, other distances from break-away score 1010 and side edge 1086 are possible. When the material of circular through cut 1091 is removed, the resulting aperture communicates with base edge 1080 by breaking the material between circular through cut 1091 and slit 1092. In other words, base edge 1080 has a point of discontinuity such that base edge 1080 can in communicate with circular through cut 1091.

Along score 1010, price piece 1018 also includes a tab portion 1093 coupled to price piece 1018 by a tab connecting portion 1094. While the majority of score 1010 is a continuous groove formed in the sheet material, the perimeter of tab portion 1093 and tab connecting portion 1094 are through cuts in the sheet material. It should be realized that other types of markings are possible. For example, the perimeter of tab portion 1093 and tab connecting portion 1094 can be a continuous groove formed in the sheet material or perforations. Tab connecting portion 1094 is defined at least between a first tab bend line 1097 spaced apart from a second tab bend line 1096. First and second tab bend lines 1097 and 1096 are spaced apart by a distance 1097. For example, distance 1097 can be about 1.8 cm. In one embodiment, first and second tab bend lines 1095 and 1096 are continuous grooves. However, it should be realized that first and second tab bend lines 1095 and 1096 can be other types of suitable markings, such as perforations that would aid in bending the sheet material along the marking.

Figure 15B:
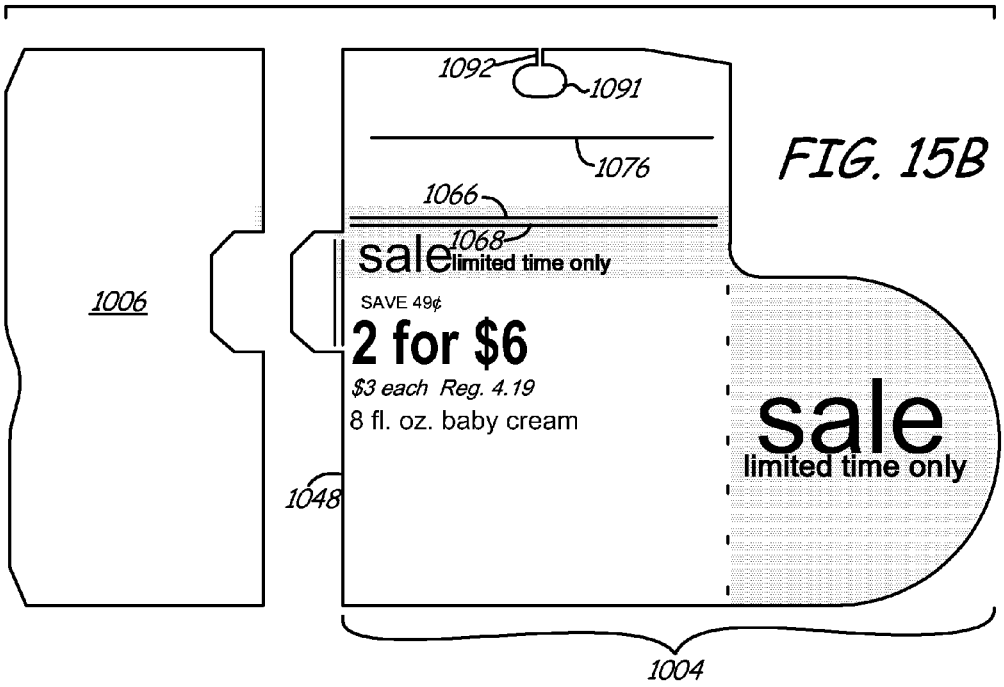
FIG. 15B is a front view of the in-store marketing sign of FIG. 15A with a detached break-away section.

FIG. 15B is a front view of in-store marketing sign 1000 of FIG. 15A with the break-away section 1006 removed from main section 1004. In the store, a user detaches break-away section 1006 from main section 1004 at score 1010 (FIG. 15A) and discards break-away section 1006. By detaching break-away section 1006, score 1010 becomes the left side edge 1048 of main section 1004, which a portion of left side edge is substantially perpendicular to first connecting bend line 1066, second connecting bend line 1068 and base bend line 1076. In addition, material from circular through cut 1091 and slit 1092 are removed such that circular through cut 1091 and base edge 1080 are in communication.

Figure 16A:
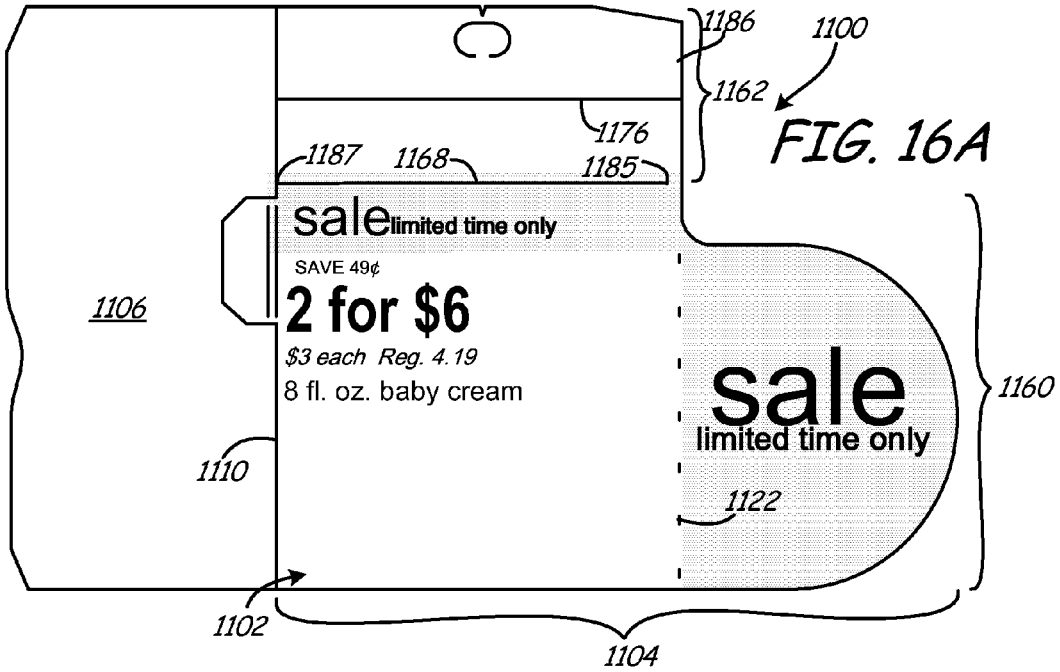
FIG. 16A is a front view of an in-store marketing sign for a peg-type display structure according to another
Figure 16B:
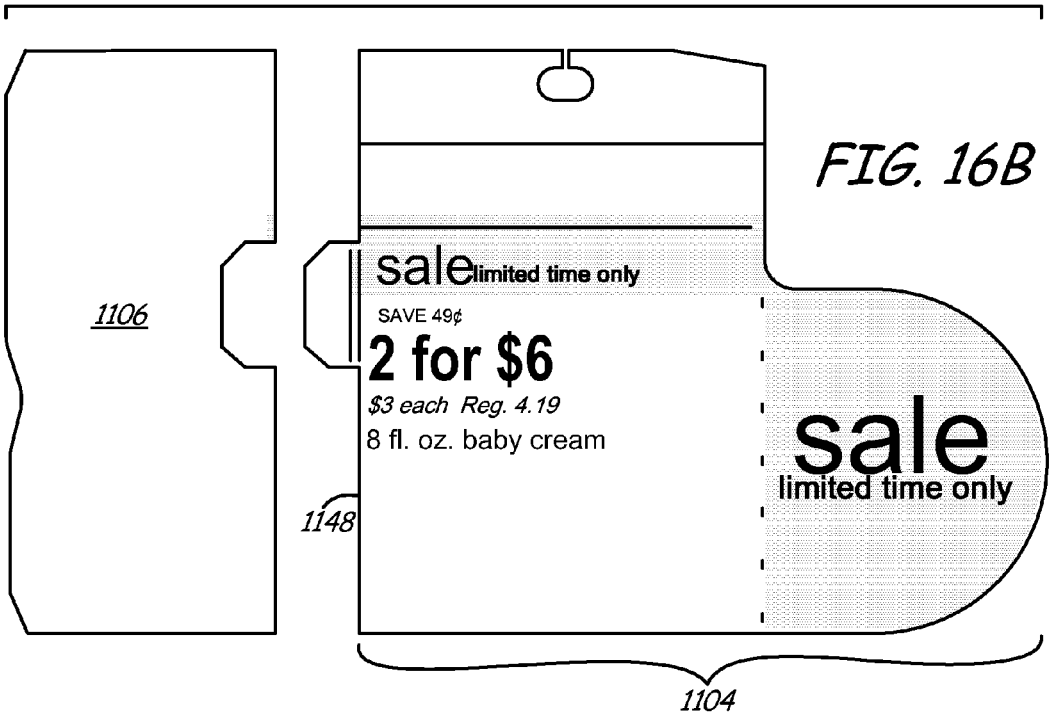
FIG. 16B is a front view of the in-store marketing sign of FIG. 16A with a detached break-away section.

FIG. 16A is a front view of a marketing sign 1100 showing a front surface 1102 according to one embodiment. FIG. 16B is a front view of in-store marketing sign 1100 of FIG. 16A with a break-away section 1106 removed from main section 1104 at score 1110 to form left side edge 1148 of main section 1104.

Marketing sign 1100, like marketing sign 1000, is formed with a pliable yet resilient sheet material and is for use with a peg-type product display structure. All features of marketing sign 1100 are similar to the features of marketing sign 1000 including having a main section 1104 and a break-away section 1106 coupled together by a score 1110. However, where marketing sign 1000 has a free portion coupled to a base portion by a connecting portion, marketing sign 1100 has a free portion 1160 of main section 1104 coupled to a base portion 1162 by a single connecting bend line 1168.

Under one embodiment, connecting bend line 1168 is a continuous groove that extends from a first end 1185 to a second end 1187. A first end 1185 of connecting bend line 1168 is located a spaced distance from right side edge 1186 of base portion 1162 and second end 1187 of connecting bend line 1168 intersects with score 1110.

During manufacturing of in-store marketing sign 1100, score 1110, connecting bend line 1168, base bend line 1176 and fold 1122 are all formed with a laser. In one embodiment, the laser forms connecting bend line 1168 with a wider and deeper groove than the grooves of score 1110 base bend line 1176 and fold 1122. In addition, in the embodiment illustrated in FIG. 16A, base bend line 1176 intersects both score 1110 at one end and intersects right side edge 1186 of base portion 1162 at a second end.

Figure 17:
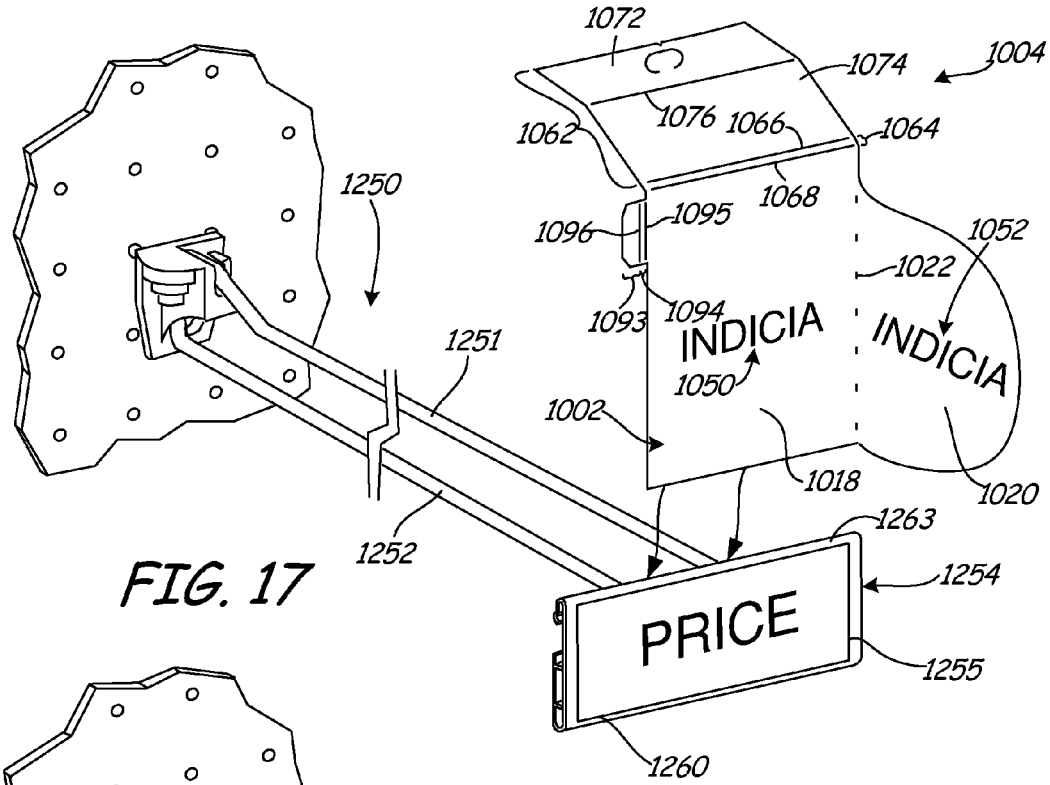
FIG. 17 is a perspective view of the remaining portion of the in-store marketing sign illustrated in FIG. 15B exploded from a peg-type display structure according to one embodiment.
Figure 18:
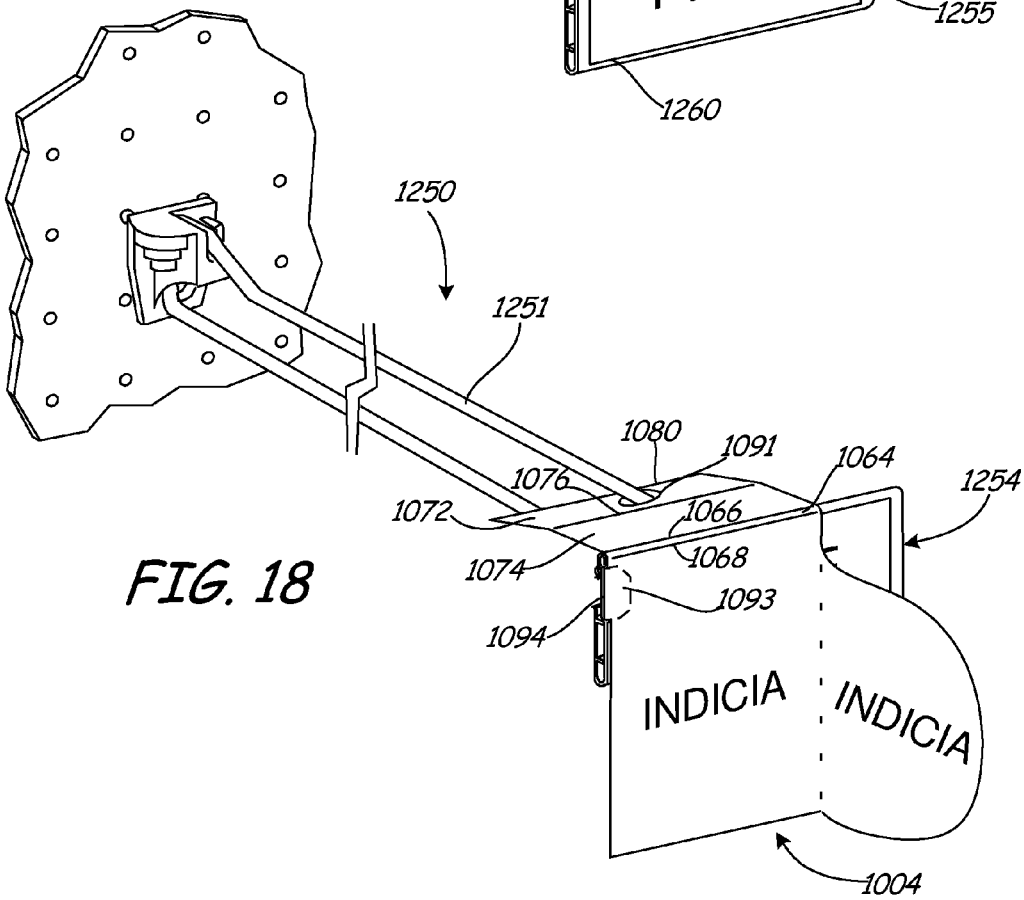
FIG. 18 is a perspective view of the remaining portion of the in-store marketing sign illustrated in FIG. 15B mounted to the peg-type display structure illustrated in FIG. 17.

FIG. 17 is a perspective view of marketing sign 1000 illustrated in FIG. 15A as exploded from a perspective view of a peg-type display structure 1250 having a price label holder 1254 according to one embodiment. While FIG. 17 illustrates marketing sign 1000, shelf type display structure 1250 can also accommodate marketing sign 1100 illustrated in FIGS. 16A and 16B in the same way. In FIG. 18, marketing sign 1000 is bent at its bend or fold lines. For example, first and second connecting bend lines 1066 and 1068 are bent such as to define connecting portion 1064. Base bend line 1076 is bent to define engaging piece 1072 and support piece 1074. Fold 1022 is bent such that balloon piece 1020 oriented out-of-plane from front surface 1002 of price piece 1018. First tab bend line 1095 and second tab bend line 1096 are bent such as to define tab connecting portion 1094.

Peg-type display structure 1250 includes a top peg fixture 1251 and a bottom peg fixture 1252. Price holder 1254 is coupled to a free end of top peg fixture 12151. Bottom peg fixture 1252 is configured to support product for display. Price holder 1254 is configured to retain a price label 1255, which is indicative of product information and price information of the product supported by bottom peg fixture 1252.

Price holder 1254 is typically formed of a polymer such as plastic, while top and bottom peg fixtures 1251 and 1252 are typically formed of a metal. At least front side 1260 of price holder 1254 is formed of a transparent polymer such that a price label 1255 can be clearly viewed. Price holder 1254 includes a top edge 1263 and sides. Price label 1255 can be inserted into the price holder 1254 from either side.

To physically alter the price holder 1254, marketing sign 1000 is configured to be bent and then coupled to price holder 1254 so as to cover the regular price label 1255 with price piece 1018 of free portion 1060. In one embodiment, price piece 1018 includes indicia 1070 indicative of a price of a product and product information of which sign 1000 is marketing and balloon piece 1020 includes indicia 1052 indicative of promotional information about the product the sign 1000 is marketing. Indicia are also located on a back side of balloon piece 1020 (not specifically illustrated) such that indicia on balloon piece 1020 are double sided. Upon marketing sign 1000 covering the regular price label 1255, marketing sign 1000 indicates a new price with indicia 1050 located on price piece 1018 and further highlights promotional features of the product with indicia 1052 located on balloon piece 1020.

FIG. 18 is a perspective view of marketing sign 1000 as mounted to a perspective view of peg-type display structure 1250 after insertion. While FIG. 18 illustrates marketing sign 1000, shelf type display structure 1250 can also accommodate marketing sign 1100 illustrated in FIGS. 16A and 16B in the same way. As illustrated in FIGS. 17 and 18, marketing sign 1000 is coupled to price holder 1254 such that tab portion 1093 is inserted into a side end of the price holder, base portion 1062 engages with top peg fixture 1251 and free portion 1060 lies flat against front side 1260 of price holder 1254 and therefore in front of price label 1255.

As illustrated in FIGS. 17 and 18, tab connecting portion 1094 defined at least by first and second tab bend lines 1095 and 1096, which are spaced apart by distance 1097 (FIG. 15A), is sized to correspond at least with a thickness of a side edge of price holder 1254. By tab connecting portion 1094 being sized to correspond with at least the thickness of a side edge, price label holder 1254 is allowed to support free portion 1060 of marketing sign 1000 against front side 1260 of the price holder 1254. More specifically, distance 1097 (FIG. 15A) is sized to correspond with the thickness of a side edge and thickness of price label 1255.

Base bend line 1076 is bent such that top peg fixture 1251 is located within the aperture created by circular through cut 1091 of engaging piece 1072, which is in communication with base edge 1080 via slit 1092 (FIG. 15A). In such a configuration, marketing sign 1000 is secured to peg-type display structure 1250. It should be realized, however, that base portion 1062 can be coupled to peg fixture 1251 with other attachment means without the need for the aperture created by circular through cut 1091. For example, base portion 1062 can couple to peg fixture 1251 using an adhesive or clip.

Connecting portion 1064 defined at least by first and second connecting bend lines 1066 and 1068, which are spaced apart by distance 1070 (FIG. 15A), is sized to correspond with a thickness of top edge 1263 of price holder 1254. By connecting portion 1264 being sized to correspond with a thickness of top edge 1263, top edge 1263 is allowed to support connecting portion 1064 of marketing sign 1000 at first and second connecting bend lines 1066 and 1068 and be in contact with connecting portion 1064. As illustrated in FIG. 18, free portion 1060 is oriented substantially normal to connecting portion 1064.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A marketing sign comprising:

a sheet material having at least one break-away section and a main section coupled to the at least one break-away section by at least one score, the main section comprising:

a base portion configured to couple with a product display structure after the main section is detached from the at least one break-away section;

a free portion including a price piece having indicia indicative of a price of a product that the sign is marketing and a balloon piece coupled to the price piece at a fold, the balloon piece including indicia indicative of information about the product; and a connecting bend line coupling the free portion to the base portion, the connecting bend line having a first end located a spaced distance from a right side edge of the sheet material.

2. The marketing sign of claim 1, wherein the connecting bend line further comprises a second end that intersects with the at least one score.

3. The marketing sign of claim 1, wherein the connecting bend line further comprises a second end that intersects with a base left side edge of the base portion of the sheet material.

4. The marketing sign of claim 1, wherein the connecting bend line further comprises a continuous groove that extends from the first end of the connecting bend line to the second end of the connecting bend line.

5. A marketing sign comprising:

a sheet material having a bottom edge, at least one break-away section and a main section coupled to the at least one break-away section by at least one score, wherein a top of the main section is defined by the at least one score and a bottom of the main section is defined by the bottom edge of the sheet material, the main section comprising:

a price portion including indicia indicative of a price of a product that the sign is marketing; and a balloon portion coupled to the price portion at a bend that is in alignment with a break-away right side edge of the at least one break-away section and a right side edge of the main section, the balloon portion including indicia indicative of information about the product and is configured to be oriented out-of-plane from the price portion after the at least one break-away section is detached from the main section.

6. The marketing sign of claim 5, wherein the at least one break-away section is defined at least by a break-away top edge, the at least one score, the break-away right side edge and a break-away left side edge.

7. The marketing sign of claim 5, wherein the at least one score comprises a first groove, a second groove and a third groove, wherein a second end of the first groove is located a spaced distance from a first end of the second groove and a second end of the second groove located a spaced distance from a first end of the third groove.

8. The marketing sign of claim 7, wherein a first end of the first groove is located a spaced distance from a left side edge of the sheet material and a second end of the third groove is located a spaced distance from a right side edge of the sheet material.

9. The marketing sign of claim 5, wherein the at least one score comprises a first score and a second score, the first score defining a side of the main section and being substantially perpendicular to the second score that defines the top of the main section, wherein the at least one break-away section is coupled to the main section by the first score and the second score.

10. The marketing sign of claim 9, wherein the first score comprises a first through cut, a groove and a second through cut, wherein a second end of the second through cut is located a spaced distance from the bottom edge of the sheet material, a first end of the second through cut is located a spaced distance from a second end of the groove and the first end of the groove is located a spaced distance from a second end of first through cut.

11. The marketing sign of claim 10, wherein the second score comprises a through cut and a groove, wherein a second end of the groove of the second score is located a spaced distance from a right side edge of the sheet material and a first end of the groove of the second score is located a spaced distance from a second end of the through cut of the second score.

12. The marketing sign of claim 11, wherein a first end of the first through cut of the first score intersects with a first end of the through cut of the second score.

13. A method of altering a product display structure in a retail store, the method comprising:

obtaining at least one marketing sign made of sheet material having at least one break-off portion and a main portion coupled to the at least one break-off portion by at least one score, the main portion comprising:

a base portion;

a free portion including a price piece having indicia indicative of a price of a product that the sign is marketing and a balloon piece coupled to the price piece at a fold, the balloon piece including indicia indicative of information about the product;

a connecting bend line coupling the base portion to the free portion;

detaching the at least one break-off portion from the main portion at the at least one score;

discarding the at least one break-off portion; and physically altering a product display structure with the marketing sign by engaging the base portion with a price holder of a product display structure and orienting the balloon piece out-of-plane from the price piece by bending the sheet material at the fold.

14. The method of claim 13, wherein obtaining the marketing sign having at least one score comprises obtaining the marketing sign having a first score and a second score, the first score defining a side of the main portion and being substantially perpendicular to the second score which defines the top of the main portion, wherein the at least one break-off portion is coupled to the main portion by the first score and the second score.

15. A marketing sign comprising:

a sheet material having a break-away section and a main section coupled to the break-away section by at least one score, the main section comprising:

a free portion defined on one side by the at least one score;

a base portion defined on one side by the at least one score and configured to couple with a product display structure after the break-away section is detached from the main section at the at least one score, the product display structure having a price holder; and a connecting bend line coupling the base portion to the free portion, the connecting bend line intersecting the at least one score at a first end.

16. The marketing sign of claim 15, wherein the base portion comprises a base edge configured to couple with the product display structure at one of an extension of the price holder and a bull nose of the product display structure.

17. The marketing sign of claim 15, wherein the sheet material further comprises:

a tab portion and a tab connecting portion defined at least by a through cut in the sheet material that intersects with the score that couples the break-away section to the main section, the tab connecting portion being defined between a first tab bend line spaced apart from a second tab bend line by a second distance.

18. The marketing sign of claim 17, wherein the second distance at least substantially corresponds with a side edge thickness of the price holder.

19. The marketing sign of claim 16, wherein the free portion comprises a price piece including indicia indicative of a price of a product that the sign is marketing and a balloon piece including indicia indicative of information about the product, wherein the price piece and the balloon piece are coupled together at a fold oriented substantially perpendicular to the connecting bend line.

20. The marketing sign of claim 19, wherein the balloon piece comprises a top edge spaced apart from the connecting bend line and the price piece comprises a side edge oriented substantially perpendicular to the connecting bend line, wherein the top edge of the balloon piece joins with the side edge of the price piece at an angle that is greater than 90 degrees and less than 180 degrees.

21. The marketing sign of claim 20, wherein a portion of the top edge of the balloon piece is partially curved.

* * * * *